US011547194B2

(12) United States Patent
Salas

(10) Patent No.: US 11,547,194 B2
(45) Date of Patent: Jan. 10, 2023

(54) MODULAR COSMETIC CASE SYSTEMS AND METHODS

(71) Applicant: Pieriplast S.A.C., Lima (DE)

(72) Inventor: Lia Giovanna Bacigalupo Salas, Lima (DE)

(73) Assignee: Pieriplast S.A.C., Lima (PE)

( * ) Notice: Subject to any disclaimer, the term of this patent is extended or adjusted under 35 U.S.C. 154(b) by 39 days.

(21) Appl. No.: 17/179,239

(22) Filed: Feb. 18, 2021

(65) Prior Publication Data

US 2021/0259387 A1 Aug. 26, 2021

(30) Foreign Application Priority Data

Feb. 21, 2020 (PE) ..... 000272-2020/DIN

(51) Int. Cl.
*A45D 42/02* (2006.01)
*A45D 33/22* (2006.01)
(Continued)

(52) U.S. Cl.
CPC ..... *A45D 33/22* (2013.01); *A45D 33/008* (2013.01); *A45D 40/221* (2013.01); *A45D 2040/226* (2013.01)

(58) Field of Classification Search
CPC .... A45D 33/22; A45D 33/008; A45D 40/221; A45D 2040/226; A45D 33/24;
(Continued)

(56) References Cited

U.S. PATENT DOCUMENTS 4,589,431 A 5/1986 Yuhara
4,967,924 A * 11/1990 Murofushi ..... H02G 3/14 220/831
(Continued)

FOREIGN PATENT DOCUMENTS

KR 1988-0004114 Y1 11/1988
WO 2006/122290 A2 11/2006

OTHER PUBLICATIONS https://www.cuemath.com/geometry/concave-shapes-functions/#definition:concave/ (Year: 2021).*
(Continued)

*Primary Examiner* — Edward Moran
*Assistant Examiner* — Luis M Ruiz Martin
(74) *Attorney, Agent, or Firm* — Acuity IP, LLC; Nathan S. Cassell

(57) ABSTRACT

Modular cases for cosmetic products include a base having on a first lateral side a longitudinal slot and a protrusion on the slot, and on a second lateral side a central perforation with a vertical element. Cases can also include a cover having on a first lateral side a plurality of longitudinal protuberances corresponding to the protrusion, and on a second lateral side a central perforation corresponding to the vertical element of the base. A case can also a housing for a container cosmetic products, having a first lateral side with a plurality of longitudinal protuberances corresponding with the protrusion of the base and sliding on the longitudinal slot of the base, a longitudinal slot on the plurality of longitudinal protuberances, and a protrusion on the longitudinal slot. The housing can include on a second lateral side a central perforation corresponding to a vertical element of the base.

8 Claims, 24 Drawing Sheets

(51) Int. Cl.
*A45D 40/22* (2006.01)
*A45D 33/00* (2006.01)

(58) Field of Classification Search
CPC ..... A45D 33/18; A45D 40/24; A45D 40/22; A45D 2040/225; A45D 33/20; A45D 2200/05; A45C 11/008; A45C 13/005; B65D 43/20; B65D 90/008; B65D 2251/10; E05D 2015/485
USPC ..... 132/301
See application file for complete search history.

(56) References Cited

U.S. PATENT DOCUMENTS

| | | | | |
|---|---|---|---|---|
| 6,357,945 | B1 | 3/2002 | Losier et al. | |
| 6,901,937 | B2 | 6/2005 | Sebban | |
| D508,164 | S | 8/2005 | Coe et al. | |
| 7,472,793 | B2 | 1/2009 | Berghaeuser et al. | |
| 7,849,863 | B2 | 12/2010 | Corbellini | |
| 9,375,071 | B1 * | 6/2016 | Wang | A45D 33/22 |
| 2005/0051454 | A1 | 3/2005 | Coe et al. | |
| 2015/0027487 | A1 * | 1/2015 | Apodaca | A45D 33/16 132/307 |

OTHER PUBLICATIONS

Bacigalupo, Lia 2019 Amfora Packaging: ModuCase Junio2019, YouTube, retrieved from the Internet on Feb. 22, 2021: URL: https://www.youtube.com/watch?v=pLrxQbiQDgk.

* cited by examiner

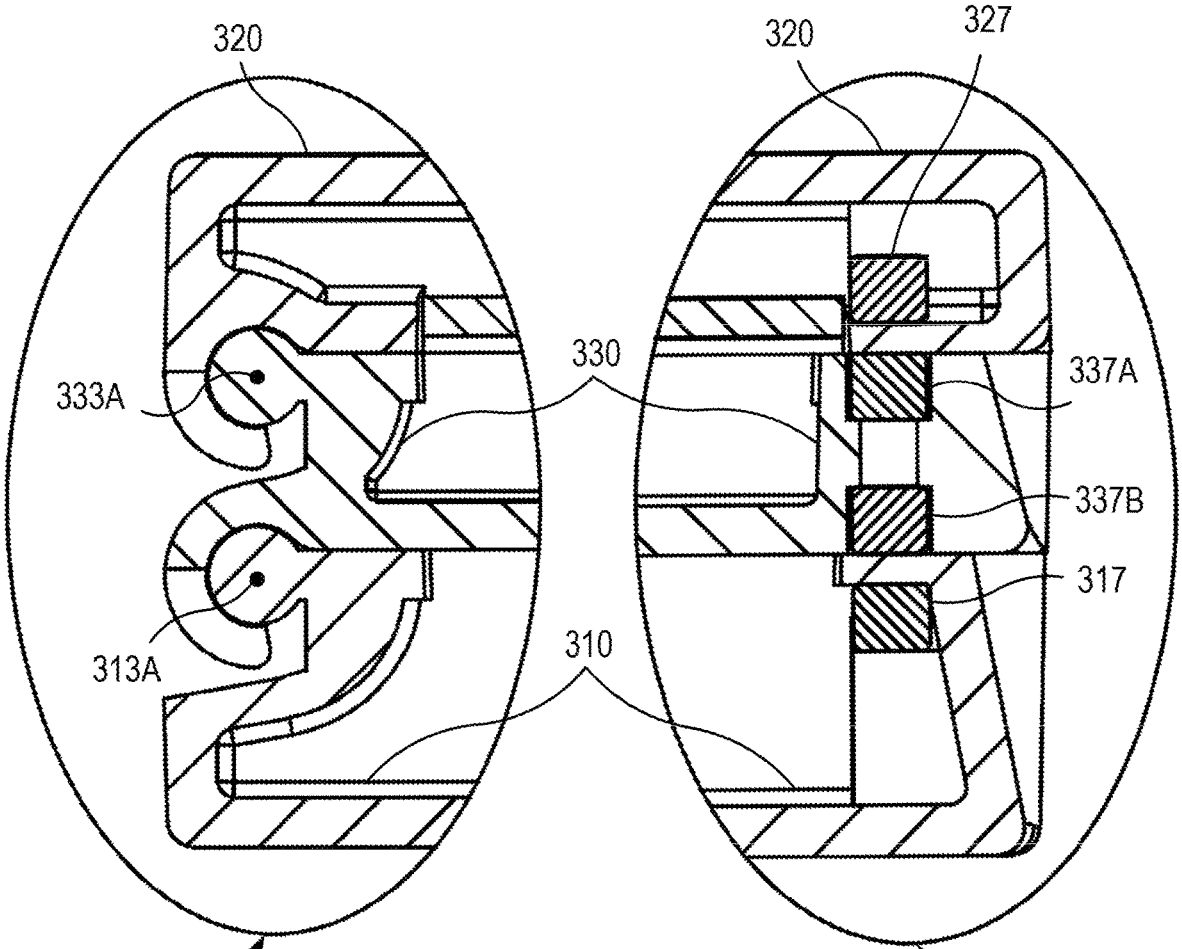
FIG. 3K-1
FIG. 3K-2
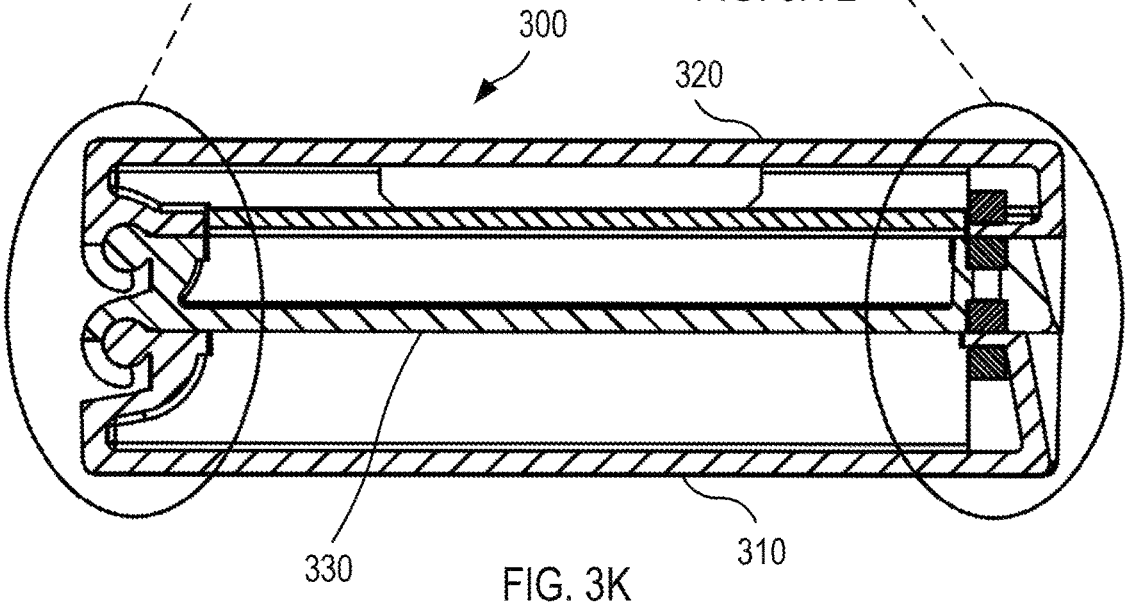
FIG. 3K

MODULAR COSMETIC CASE SYSTEMS AND METHODS

CROSS-REFERENCES TO RELATED APPLICATIONS

This application claims the benefit of prior-filed Peruvian Patent Application No. 000272-2020/DIN filed Feb. 21, 2020, the content of which is incorporated herein by reference.

BACKGROUND

Embodiments of the present invention relate to cosmetic cases, and in particular to modular cosmetic systems and methods having interchangeable and replaceable components.

A wide variety of container cases for creams, jellies and other pasty materials are currently available. Although such designs provide users with viable options for storing their cosmetics, still further improvements are desirable. Embodiments of the present invention provide solutions to these outstanding needs.

BRIEF SUMMARY

Embodiments of the present invention encompass modular cosmetic cases for pasty products and other cosmetic formulations. Exemplary embodiments include assembled and interchangeable cases.

In some embodiments, a modular cosmetic device provides an assembly or kit of compact case components that allows an end user to build their own case defining the number of levels or tiers they want to use at different moments of their daily lives, having the option to add or remove colors of eye shadows, skin base, blush powder, lip shimmer, powder eyeliner, and other cosmetic products. A user can also have the option of adding a secret compartment. In some cases, a secret compartment can be used for non-cosmetic items. The modular nature of the case components enables the user to deploy multiple decoration options, in various combinations and permutations, in any desired number (e.g. by adding or removing individual intermediate housings or inserts), to build their own exclusive compact case. Exemplary modular cosmetic case embodiments also provide for an ergonomic opening feature.

Modular cosmetic case systems and methods disclosed herein involve a modular concept whereby a housing is slidably coupled laterally to a case. In exemplary embodiments, systems and methods provide the modularity of at least one housing, and that at least one housing can be slidably interchanged and combined to suit the user.

An exemplary modular case for cosmetics such as pasty products can include a base having on a first lateral side a longitudinal slot and a protrusion on the slot, and on a second lateral side opposite the first a central perforation with at least one vertical element. A case can also have a cover having on a first lateral side a plurality of longitudinal protuberances corresponding to the protrusion, and on a second lateral side opposite the first a central perforation corresponding to the at least a vertical element of the base. A case may further include a first housing for a container for pasty products, which has a first lateral side that includes a plurality of longitudinal protuberances corresponding with the protrusion of the base and sliding on the longitudinal slot of the base, a longitudinal slot on the plurality of longitudinal protuberances, and a protrusion on the longitudinal slot, and on a second lateral side opposite the first lateral side a central perforation corresponding to the at least one vertical element of the base. What is more, a case may have at least a second housing for a container for pasty product, having a first lateral side that includes a plurality of longitudinal protuberances corresponding with the protrusion of the first housing and sliding on the longitudinal slot of the first housing, a longitudinal slot on the plurality of longitudinal protuberances, and a protrusion on the longitudinal slot, and on a second lateral side opposite the first lateral side a central perforation. Advantageously, the case provides a modular and interchangeable functionality. The case can be used to store any of a variety or combination of cosmetic products, including without limitation creams, jellies, and other pasty materials In a first aspect, embodiments of the present invention encompass modular cosmetic case systems and methods. An exemplary modular cosmetic case includes a cover, a housing (or multiple housings), and a base. A cover can have a first lateral side and a second lateral side, and the first lateral side of the cover can have a plurality of protuberances. The housing can have a first lateral side and a second lateral side, and the first lateral side of the housing can have a plurality of protuberances and a plurality of slits. The base can have a first lateral side and a second lateral side, and the first lateral side of the base can have a plurality of slits. The plurality protuberances of the cover can respectively engage the plurality of slits of the housing (e.g. via slidable insertion). The plurality of protuberances of the housing can respectively engage the plurality of slits of the base (e.g. via slidable insertion).

In some cases, the first lateral side of the housing includes a longitudinal slot and a protrusion on the longitudinal slot. The first lateral side of the base can have a longitudinal slot and a protrusion on the longitudinal slot. The plurality of protuberances of the first lateral side of the cover can engage the protrusion of the first lateral side of the housing. The plurality of protuberances of the first lateral side of the housing can engage the protrusion of the first lateral side of the base. In some cases, one or more of the plurality of protuberances of the first lateral side of the cover has a concave surface. The protrusion of the first lateral side of the housing can have a convex surface. The concave surfaces of the plurality of protuberances of the first lateral side of the cover can engage the convex surface of the protrusion of the first lateral side of the housing. In some cases, one or more of the plurality of protuberances of the first lateral side of the housing has a concave surface. The protrusion of the first lateral side of the base can have a convex surface. The concave surfaces of the plurality of protuberances of the first lateral side of the housing can engage the convex surface of the protrusion of the first lateral side of the base. In some cases, one or more of the plurality of protuberances of the first lateral side of the cover has a concave surface. In some cases, one or more of the plurality of protuberances of the first lateral side of the housing has a concave surface. The protrusion of the first lateral side of the housing can have a convex surface. The protrusion of the first lateral side of the base can have a convex surface. The concave surfaces of the plurality of protuberances of the first lateral side of the cover can engage the convex surface of the protrusion of the first lateral side of the housing. The concave surfaces of the plurality of protuberances of the first lateral side of the housing can engage the convex surface of the protrusion of the first lateral side of the base.

In some cases, the housing includes a plurality of posts, and the plurality of slits of the housing are defined at least in part by the plurality of posts of the housing. In some cases, the base includes a plurality of posts, and the plurality of slits of the base are defined at least in part by the plurality of posts of the base. In some cases, the first lateral side of the housing includes a protrusion on a longitudinal slot, the protrusion defining a central longitudinal axis. The first lateral side of the base can have a protrusion on the longitudinal slot, the protrusion defining a central longitudinal axis. The central longitudinal axis of the protrusion of the housing and the central longitudinal axis of the base can be in vertical alignment when the housing and the base are in a closed configuration. The central longitudinal axis of the protrusion of the housing and the central longitudinal axis of the base can be out of vertical alignment when the housing and the base are in an open configuration.

In some cases, the first lateral side of the housing has a protrusion on a longitudinal slot, the protrusion defining a central longitudinal axis. The first lateral side of the base can have a protrusion on a longitudinal slot, the protrusion defining a central longitudinal axis. The cover and the housing can rotate relative to one another about the central longitudinal axis of the protrusion of the housing. The housing and the base can rotate relative to one another about the central longitudinal axis of the protrusion of the base. In some cases, each of the plurality of protuberances of the first lateral side of the cover has a convex surface, and each of the plurality of protuberances of the first lateral side of the housing can have a convex surface. The first lateral side of the housing can have a protrusion on a longitudinal slot, the protrusion having a concave surface. The first lateral side of the base can have a protrusion on a longitudinal slot, the protrusion having a concave surface. Each of the convex surfaces of the plurality of protuberances of the cover can engage the concave surface of the longitudinal slot of the housing. Each of the convex surface of the plurality of protuberances of the housing can engage the concave surface of the longitudinal slot of the base.

In another aspect, a modular case for pasty products or other cosmetic products can include a base and a cover. The base can have on a first lateral side a longitudinal slot and a protrusion on the slot, and on a second lateral side opposite the first a central perforation with at least one vertical element. The cover can have on a first lateral side a plurality of longitudinal protuberances corresponding to the protrusion, and on a second lateral side opposite the first a central perforation corresponding to the at least a vertical element of the base. In some cases, the modular case can also include a first housing for a container for pasty products, having a first lateral side that includes i) a plurality of longitudinal protuberances corresponding with the protrusion of the base and sliding on the longitudinal slot of the base, ii) a longitudinal slot on the plurality of longitudinal protuberances, and iii) a protrusion on said longitudinal slot. The housing can also have on a second lateral side opposite the first lateral side a central perforation corresponding to at least one vertical element of the base. In some cases, the central perforation of the cover corresponds to the central perforation of the base and that of the housing. In some cases, the case also includes at least a second housing carrier of a pasty product, having a first lateral side that includes i) a plurality of longitudinal protuberances corresponding with the protrusion of the first housing and sliding on the longitudinal slot of the first housing, ii) a longitudinal slot on the plurality of longitudinal protuberances, and iii) a protrusion on said longitudinal slot. The at least one second housing carrier can also have on a second lateral side opposite the first lateral side a central perforation. In some cases, the longitudinal slot has a concave surface. In some cases, each of the plurality of longitudinal protuberances has a convex surface. In some cases, the central perforations have a quadrangular section.

BRIEF DESCRIPTION OF THE DRAWINGS

Specific embodiments of the disclosed device, systems, or methods will now be described with reference to the drawings. Nothing in this detailed description is intended to imply that any particular component, feature, or step is essential to the invention.

FIGS. 3K, 3K-1, and 3K-2 show aspects of a modular case with the base, intermediate, and cover elements, according to embodiments of the present invention.

DETAILED DESCRIPTION

Modular cases for pasty products and other cosmetic materials can include a base and a cover. Cases may also include one or more housings. A base can include on a first lateral side a longitudinal slot and a protrusion on the slot, and on a second lateral side opposite the first a central perforation with at least one vertical element. A cover can include on a first lateral side a plurality of longitudinal protuberances corresponding to the protrusion, and on a second lateral side opposite the first a central perforation corresponding to the at least a vertical element of the base. A housing for a container for pasty products or other cosmetic materials can include a first lateral side that includes a plurality of longitudinal protuberances corresponding with the protrusion of the base and sliding on the longitudinal slot of the base, a longitudinal slot on the plurality of longitudinal protuberances, and that also includes a protrusion on the longitudinal slot. The housing can include on a second lateral side opposite the first lateral side a central perforation corresponding to at least one vertical element of the base. In addition, the case can include at least a second housing carrier of a pasty product, having a first lateral side that includes a plurality of longitudinal protuberances corresponding with the protrusion of the first housing and sliding on the longitudinal slot of the first housing, a longitudinal slot on the plurality of longitudinal protuberances, and a protrusion on the longitudinal slot. The second housing can also include on a second lateral side opposite the first lateral side a central perforation.

Figure 1A:
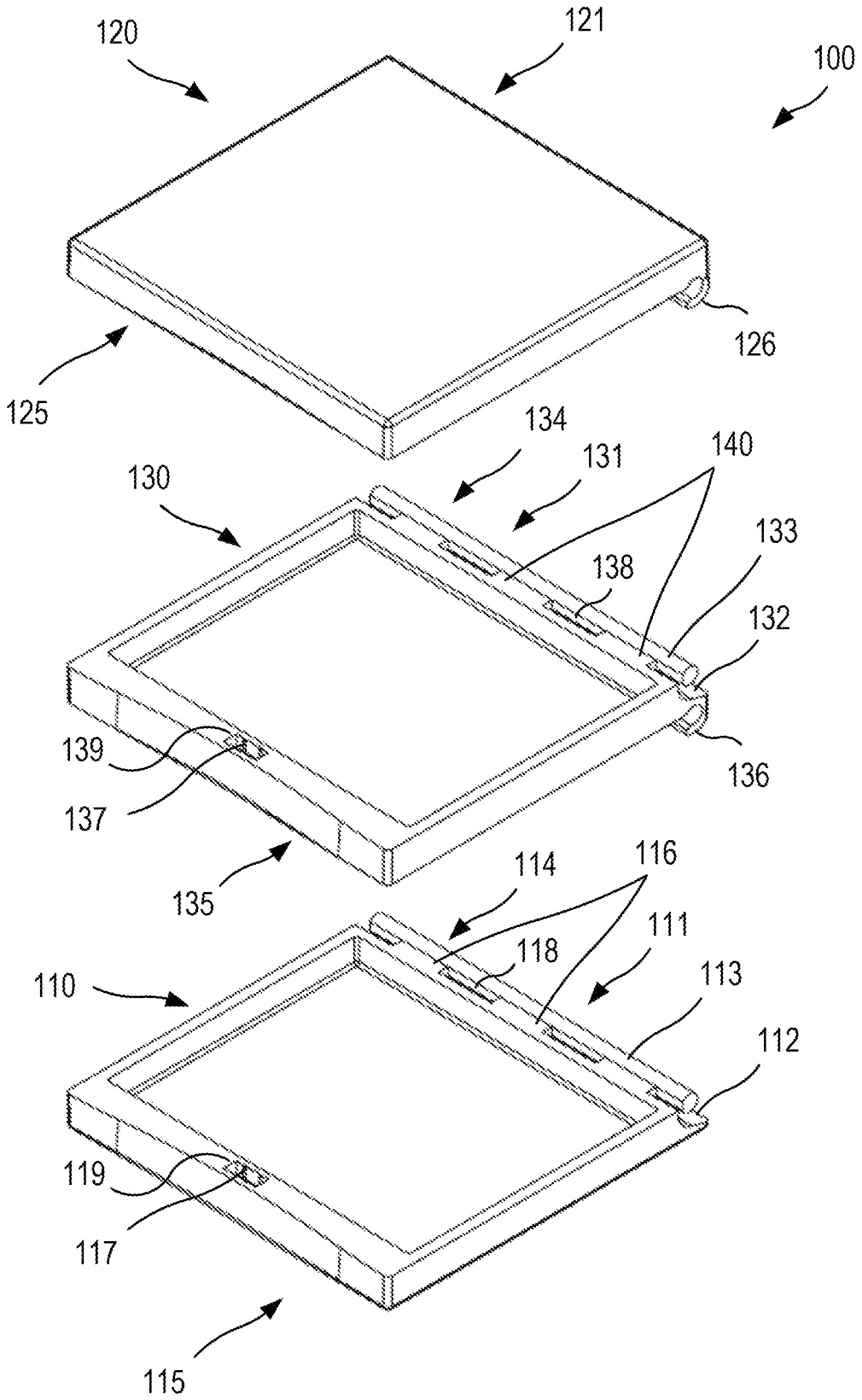
FIG. 1A shows a disassembly view of a modular case with the base, intermediate, and cover elements, according to embodiments of the present invention.

Turning now to the drawings, FIG. 1A depicts aspects of a modular cosmetic case 100, according to embodiments of the present invention. As shown in this upper perspective view, the case 100 is in an unassembled configuration. The modular cosmetic case 100 can be used for a wide variety of cosmetics, including for example pasty products. Other exemplary cosmetic products include, without limitation, eye shadow, blush, contouring product, illuminator, powder, bronzer, and the like. As shown here, modular cosmetic case 100 includes a base 110 having a first lateral side 111 (e.g. rear) and a second lateral side 115 (e.g. front) opposite the first lateral side 111. The first lateral side 111 includes a longitudinal slot 112 and a protrusion 113 on the longitudinal slot 112. The second lateral side 115 includes a central perforation 119 having at least one vertical element 117. In some cases, the vertical element 117 can include a magnet.

Modular cosmetic case 100 also includes a cover 120 having a first lateral side 121 (e.g. rear) and a second lateral side 125 (e.g. front) opposite the first lateral side 121. The first lateral side 121 includes a plurality of longitudinal protuberances 126.

Modular cosmetic case 100 further includes an insert or housing 130 (or first intermediate element) having a first lateral side 131 (e.g. rear) and a second lateral side 135 (e.g. front) opposite the first lateral side 131. The first lateral side 131 includes a plurality of longitudinal protuberances 136. The first lateral side 131 also includes a longitudinal slot 132 and a protrusion 133 on the longitudinal slot 132. The second lateral side 135 includes a central perforation 139 having at least one vertical element 137. In some cases, the vertical element 139 can include a magnet. As shown in the view depicted here, perforation 139 can be an upper perforation and vertical element 137 can be an upper vertical element.

The protrusion 113 of the base 110 is connected with the longitudinal slot 112 via a connection mechanism 114. As shown here, connection mechanism 114 includes one or more posts 116, and slits 118 are present between adjacent posts 116 and/or adjacent to posts 116. As explained elsewhere herein, individual slits 118 are configured to receive individual protuberances 136.

The protrusion 133 of the insert or housing 130 is connected with the longitudinal slot 132 via a connection mechanism 134. As shown here, connection mechanism 134 includes one or more posts 140, and slits 138 are present between adjacent posts 140 and/or adjacent to posts 140. As explained elsewhere herein, individual slits 138 are configured to receive individual protuberances 126.

Figure 1B:
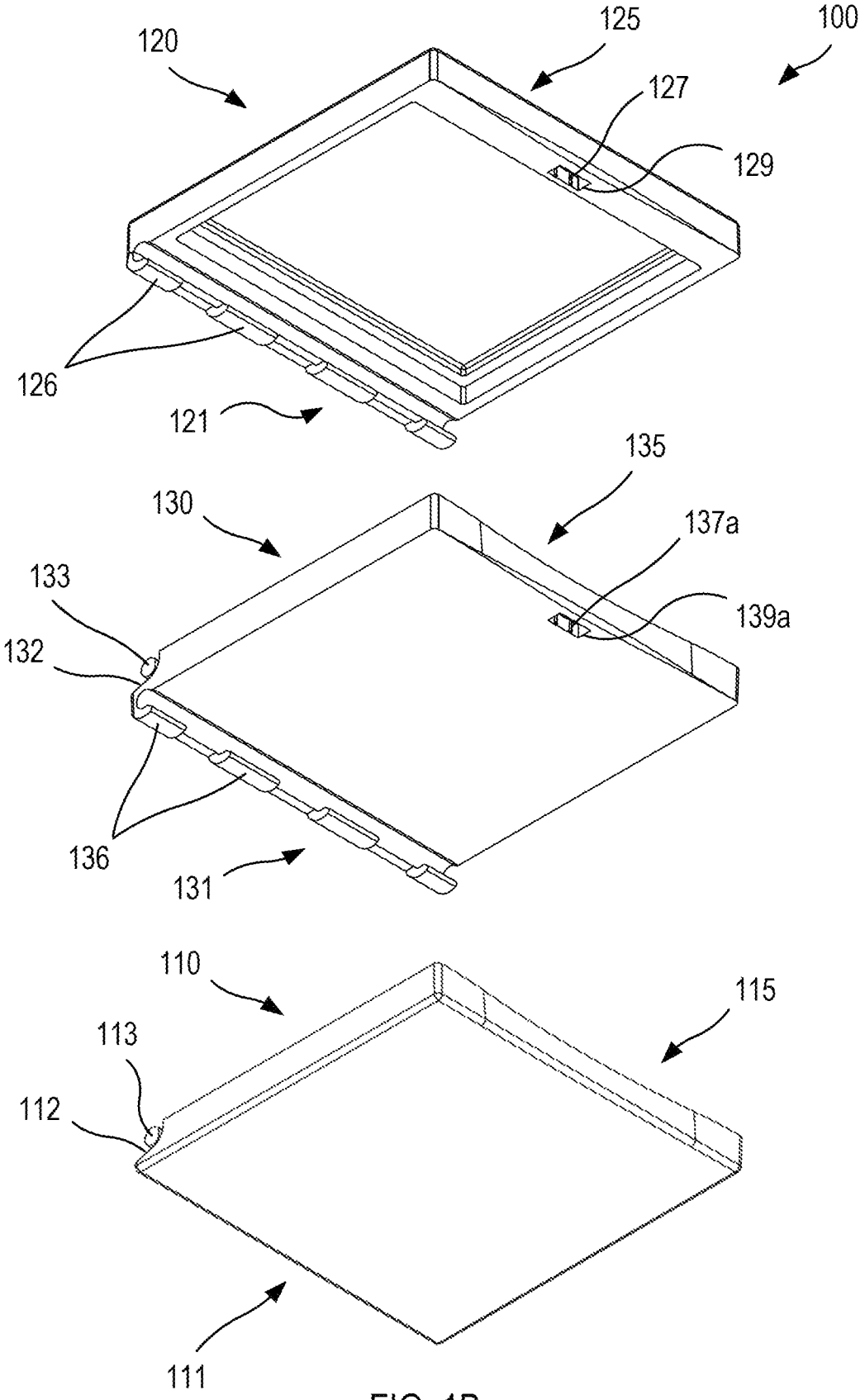
FIG. 1B shows a disassembly view of a modular case with the base, intermediate, and cover elements, according to embodiments of the present invention.

FIG. 1B depicts aspects of a modular cosmetic case 100, according to embodiments of the present invention. As shown in this lower perspective view, the case 100 is in an unassembled configuration. Modular cosmetic case 100 includes a base 110 having a first lateral side 111 (e.g. rear) and a second lateral side 115 (e.g. front) opposite the first lateral side 111. The first lateral side 111 includes a longitudinal slot 112 and a protrusion 113 on the longitudinal slot 112. The longitudinal protuberances 136 of the housing 130 correspond to the protrusion 113 of the base 110. The second lateral side 115 includes a central perforation having at least one vertical element. In some cases, the vertical element can include a magnet.

Modular cosmetic case 100 also includes a cover 120 having a first lateral side 121 (e.g. rear) and a second lateral side 125 (e.g. front) opposite the first lateral side 121. The first lateral side 121 includes a plurality of longitudinal protuberances 126. The second lateral side 125 includes a central perforation 129 having at least one vertical element 127.

Modular cosmetic case 100 further includes an insert or housing 130 (or first intermediate element) having a first lateral side 131 (e.g. rear) and a second lateral side 135 (e.g. front) opposite the first lateral side 131. The first lateral side 131 includes a plurality of longitudinal protuberances 136. The first lateral side 131 also includes a longitudinal slot 132 and a protrusion 133 on the longitudinal slot 132. The longitudinal protuberances 126 of the cover 120 correspond to the protrusion 133 of the housing 130. The second lateral side 135 includes a central perforation 139*a* having at least one vertical element 137*a*. In some cases, the vertical element 137*a* can include a magnet. As shown in the view depicted here, perforation 139*a* can be a lower perforation and vertical element 137*a* can be a lower vertical element. The lower perforation 139*a* of the housing corresponds to a vertical element of the base. The perforation 129 of the cover corresponds to a vertical element (e.g. upper vertical element) of the housing.

Figure 2A:
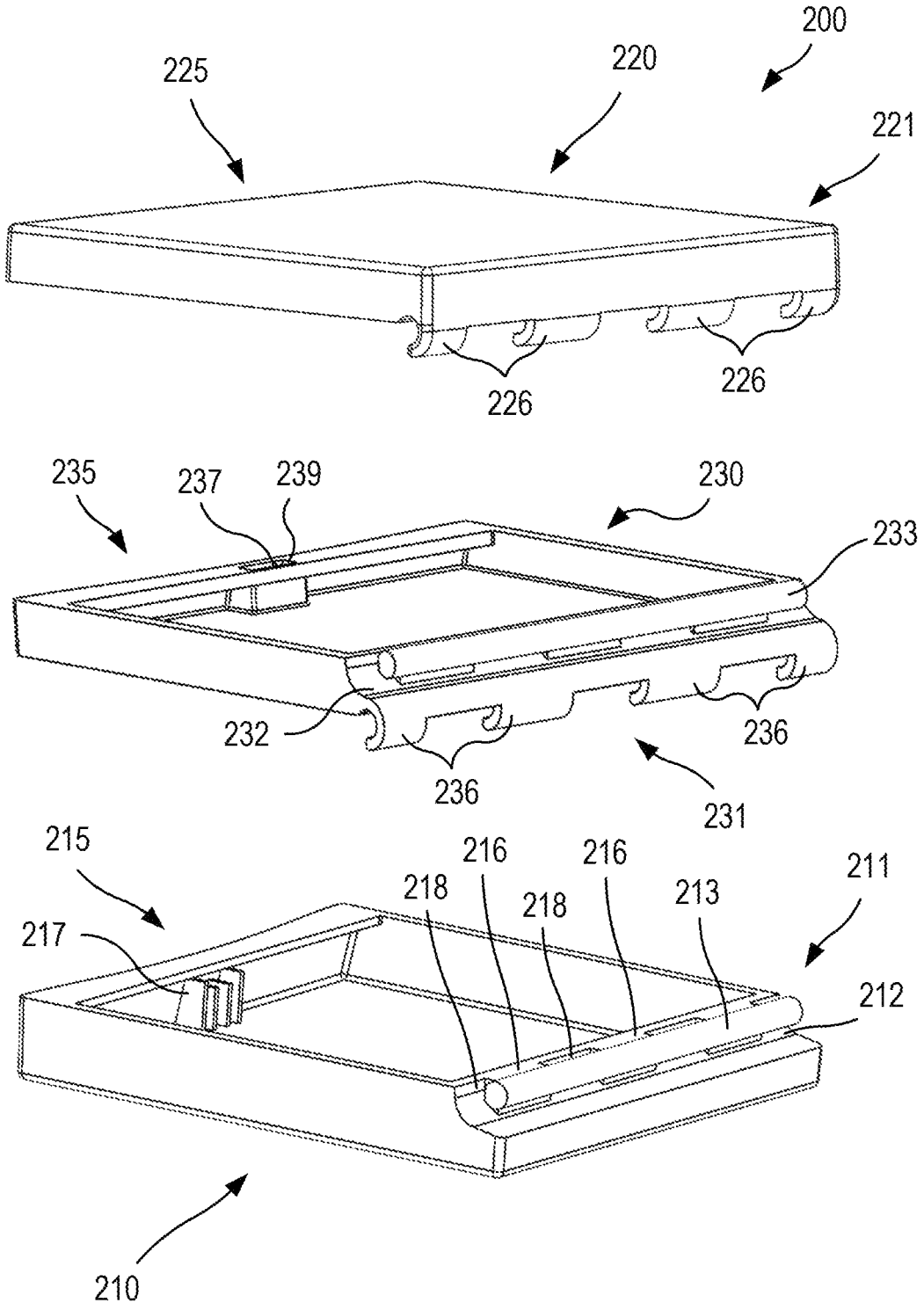
FIG. 2A shows a view of a modular case with the base, intermediate, and cover elements, according to embodiments of the present invention.

FIG. 2A depicts aspects of a modular cosmetic case 200, according to embodiments of the present invention. As shown in this upper perspective view, the case 200 is in an unassembled configuration. Modular cosmetic case 200 includes a base 210 having a first lateral side 211 (e.g. rear) and a second lateral side 215 (e.g. front) opposite the first lateral side 211. The first lateral side 211 includes a longitudinal slot 212 and a protrusion 213 on the longitudinal slot 212. The second lateral side 215 includes a central perforation and/or at least one vertical element 217. In some cases, the vertical element 217 can include a magnet.

Modular cosmetic case 200 also includes a cover 220 having a first lateral side 221 (e.g. rear) and a second lateral side 225 (e.g. front) opposite the first lateral side 221. The first lateral side 221 includes a plurality of longitudinal protuberances 226.

Modular cosmetic case 200 further includes an insert or housing 230 (or first intermediate element) having a first lateral side 231 (e.g. rear) and a second lateral side 235 (e.g. front) opposite the first lateral side 231. The first lateral side 231 includes a plurality of longitudinal protuberances 236. The first lateral side 231 also includes a longitudinal slot 232 and a protrusion 233 on the longitudinal slot 232. The second lateral side 235 includes a central perforation 239 having at least one vertical element 237. In some cases, the vertical element 237 can include a magnet. As shown in the view depicted here, perforation 239 can be an upper perforation and vertical element 237 can be an upper vertical element.

The protrusion 213 of the base 210 is connected with the longitudinal slot 212 via a connection mechanism having one or more posts 216, and slits 218 are present between adjacent posts 216 and/or adjacent to posts 216. As explained elsewhere herein, individual slits 218 are configured to receive individual protuberances 236.

Likewise, the protrusion 233 of the insert or housing 230 is connected with the longitudinal slot 132 via a connection mechanism having one or more posts, and slits are present between adjacent posts and/or adjacent to posts. As explained elsewhere herein, individual slits are configured to receive individual protuberances 226.

Figure 2B:
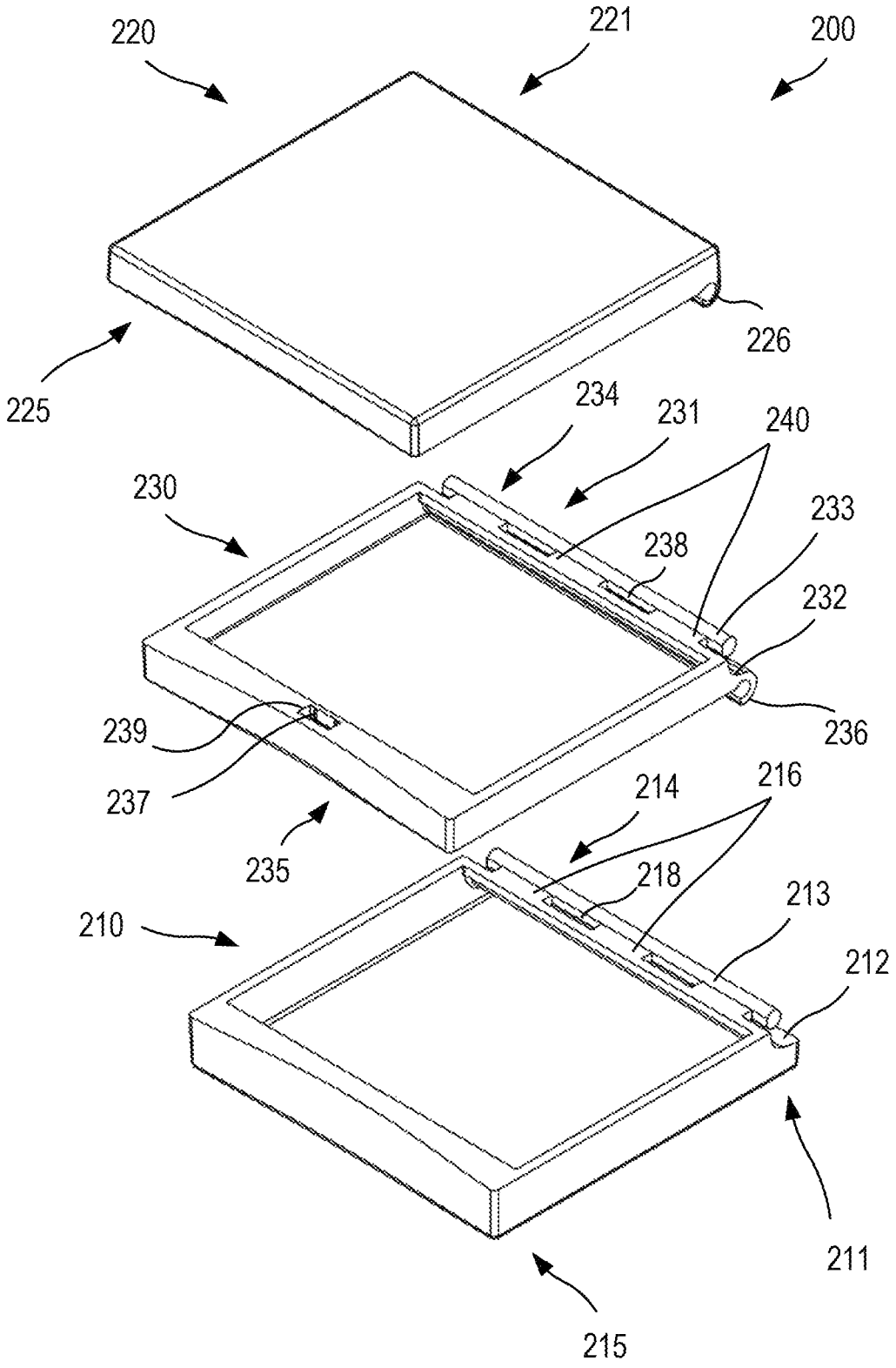
FIG. 2B shows a view of a modular case with the base, intermediate, and cover elements, according to embodiments of the present invention.

FIG. 2B depicts aspects of a modular cosmetic case 200, according to embodiments of the present invention. As shown in this upper perspective view, the case 200 is in an unassembled configuration. The modular cosmetic case 200 can be used for a wide variety of cosmetics, including for example pasty products. Other exemplary cosmetic products include, without limitation, eye shadow, blush, contouring product, illuminator, powder, bronzer, and the like. As shown here, modular cosmetic case 200 includes a base 210 having a first lateral side 211 (e.g. rear) and a second lateral side 215 (e.g. front) opposite the first lateral side 211. The first lateral side 211 includes a longitudinal slot 212 and a protrusion 213 on the longitudinal slot 212.

Modular cosmetic case 200 also includes a cover 220 having a first lateral side 221 (e.g. rear) and a second lateral side 225 (e.g. front) opposite the first lateral side 221. The first lateral side 221 includes a plurality of longitudinal protuberances 226.

Modular cosmetic case 200 further includes an insert or housing 230 (or first intermediate element) having a first lateral side 231 (e.g. rear) and a second lateral side 235 (e.g. front) opposite the first lateral side 231. The first lateral side 231 includes a plurality of longitudinal protuberances 236. The first lateral side 231 also includes a longitudinal slot 232 and a protrusion 233 on the longitudinal slot 232. The second lateral side 235 includes a central perforation 239 having at least one vertical element 237. In some cases, the vertical element 239 can include a magnet. As shown in the view depicted here, perforation 239 can be an upper perforation and vertical element 237 can be an upper vertical element.

The protrusion 213 of the base 210 is connected with the longitudinal slot 212 via a connection mechanism 214. As shown here, connection mechanism 214 includes one or more posts 216, and slits 218 are present between adjacent posts 216 and/or adjacent to posts 216. As explained elsewhere herein, individual slits 218 are configured to receive individual protuberances 236.

The protrusion 233 of the insert or housing 230 is connected with the longitudinal slot 232 via a connection mechanism 234. As shown here, connection mechanism 234 includes one or more posts 240, and slits 238 are present between adjacent posts 240 and/or adjacent to posts 240. As explained elsewhere herein, individual slits 238 are configured to receive individual protuberances 226.

Figure 3A:
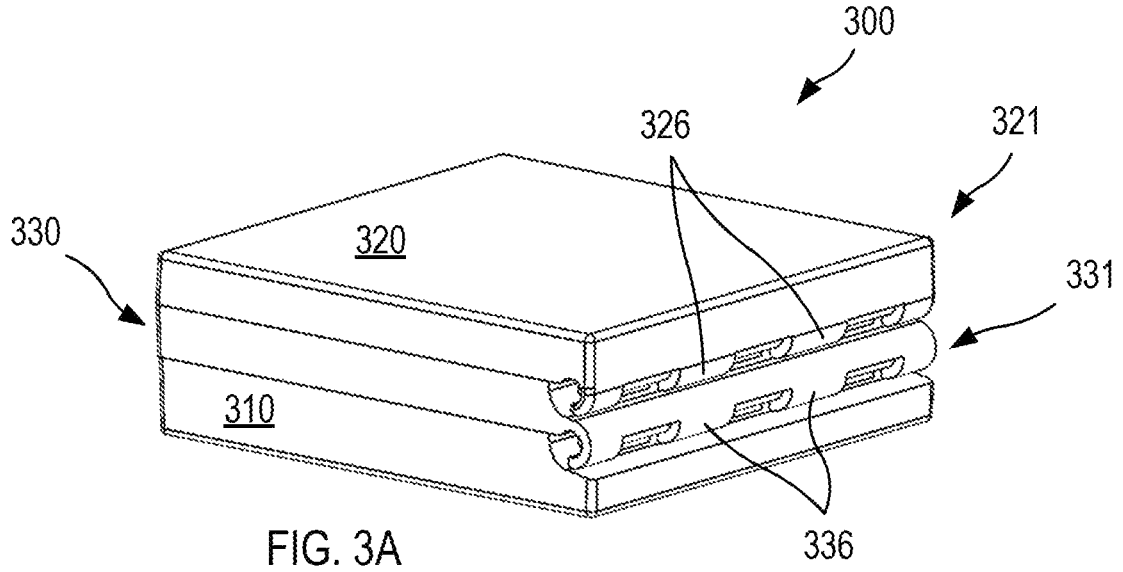
FIGS. 3A and 3B show a closed and open modular case with the base, first housing, and cover elements, according to embodiments of the present invention.

FIG. 3A depicts aspects of a modular cosmetic case 300, according to embodiments of the present invention. In this view, the case 300 is in an assembled and closed configuration. The modular cosmetic case 300 includes a base 310, a cover 320, and an insert or housing 330 (or first intermediate element) disposed between the base 310 and the cover 320. The cover 320 includes a first lateral side 321 having a plurality of longitudinal protuberances 326. As explained elsewhere herein, the plurality of longitudinal protuberances 326 correspond with a protrusion of the housing 330 and slide on a longitudinal slot of the housing 330. The housing 330 includes a first lateral side 331 having a plurality of longitudinal protuberances 336. As explained elsewhere herein, the plurality of longitudinal protuberances 336 correspond with a protrusion of the base 310 and slide on a longitudinal slot of the base 310.

Figure 3B:
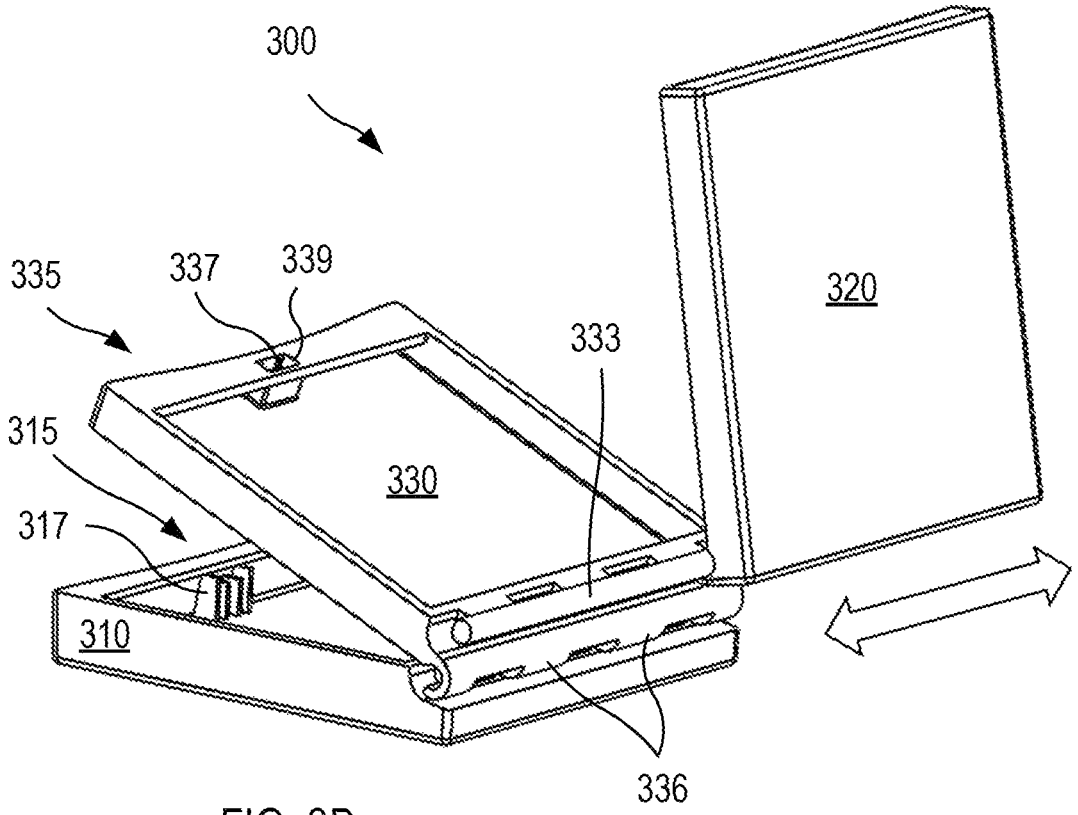

FIG. 3B depicts aspects of a modular cosmetic case 300, according to embodiments of the present invention. In this view, the case 300 is in a partially assembled and open configuration. The modular cosmetic case 300 includes a base 310, a cover 320, and an insert or housing 330 (or first intermediate element) disposed between the base 310 and the cover 320. The cover 320 includes a first lateral side having a plurality of longitudinal protuberances. As explained elsewhere herein, the plurality of longitudinal protuberances correspond with a protrusion 333 of the housing 330 and slide on a longitudinal slot of the housing 330. The housing 330 includes a first lateral side having a plurality of longitudinal protuberances 336. As explained elsewhere herein, the plurality of longitudinal protuberances 336 correspond with a protrusion of the base 310 and slide on a longitudinal slot of the base 310. A second lateral side 335 of the housing 330 includes a central perforation 339 having at least one vertical element 337. In some cases, the vertical element 337 can include a magnet. As shown in the view depicted here, perforation 339 can be an upper perforation and vertical element 337 can be an upper vertical element. A second lateral side 315 of the base 310 includes a central perforation and/or at least one vertical element 317. In some cases, the vertical element 317 can include a magnet.

Figure 3C:
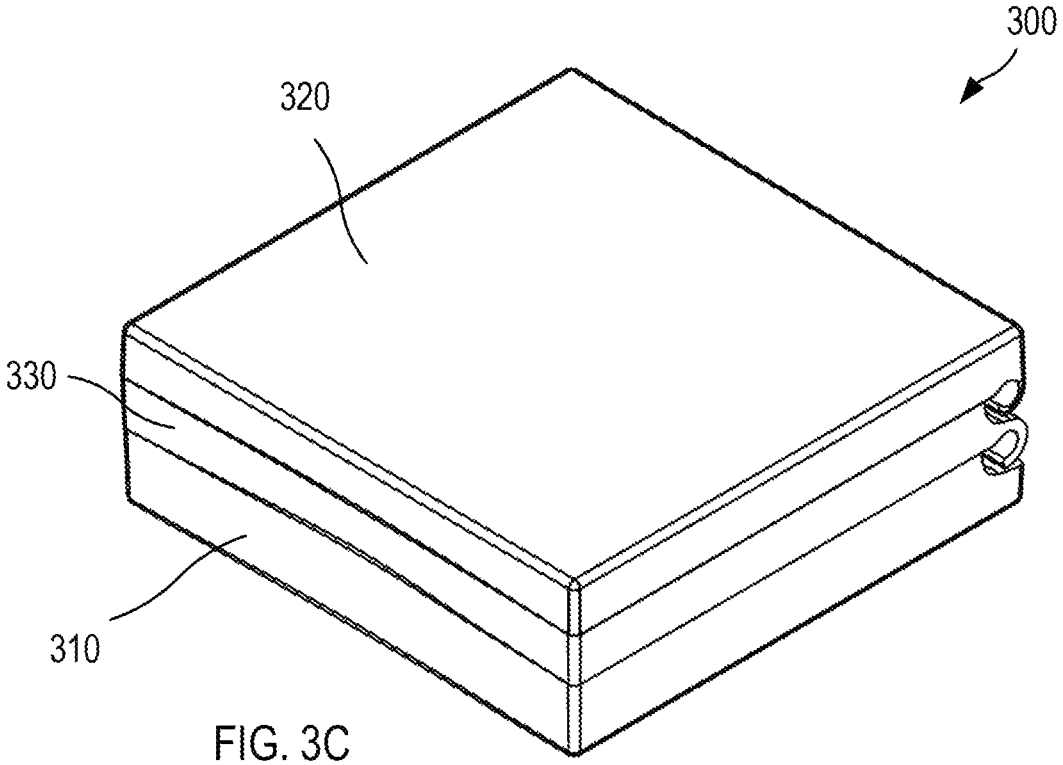
FIG. 3C shows a view of a modular case with the base, intermediate, and cover elements, according to embodiments of the present invention.

FIG. 3C depicts aspects of a modular cosmetic case 300, according to embodiments of the present invention. In this upper perspective view, the case 300 is in an assembled and closed configuration. The modular cosmetic case 300 includes a base 310, a cover 320, and an insert or housing 330 (or first intermediate element) disposed between the base 310 and the cover 320.

Figure 3D:
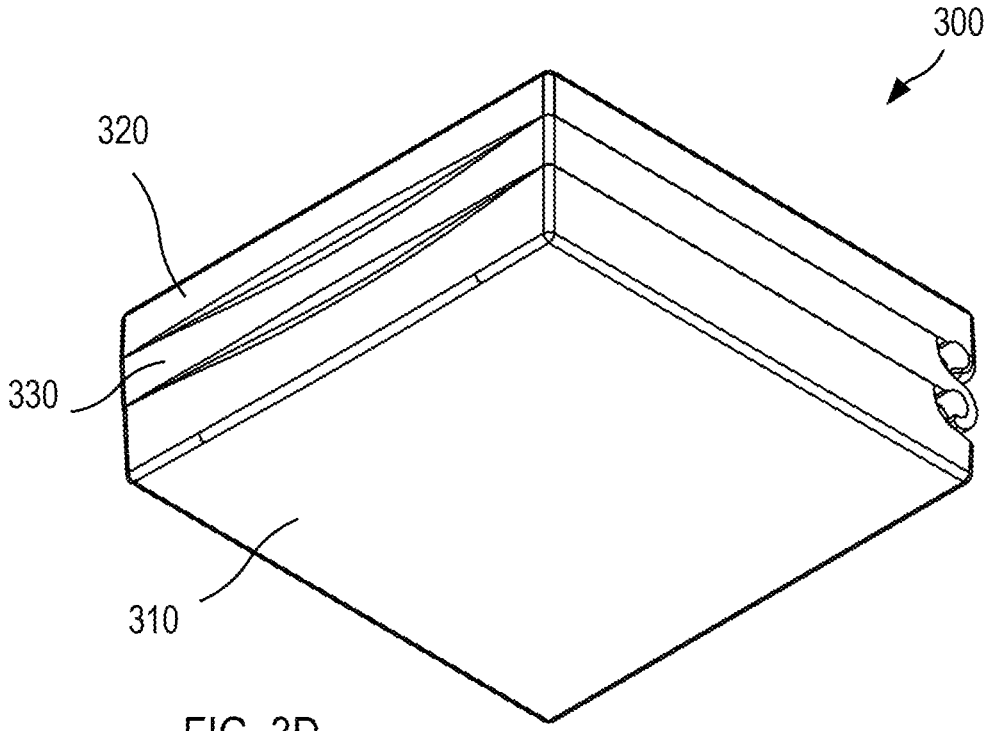
FIG. 3D shows a view of a modular case with the base, intermediate, and cover elements, according to embodiments of the present invention.

FIG. 3D depicts aspects of a modular cosmetic case 300, according to embodiments of the present invention. In this lower perspective view, the case 300 is in an assembled and closed configuration. The modular cosmetic case 300 includes a base 310, a cover 320, and an insert or housing 330 (or first intermediate element) disposed between the base 310 and the cover 320.

Figure 3E:
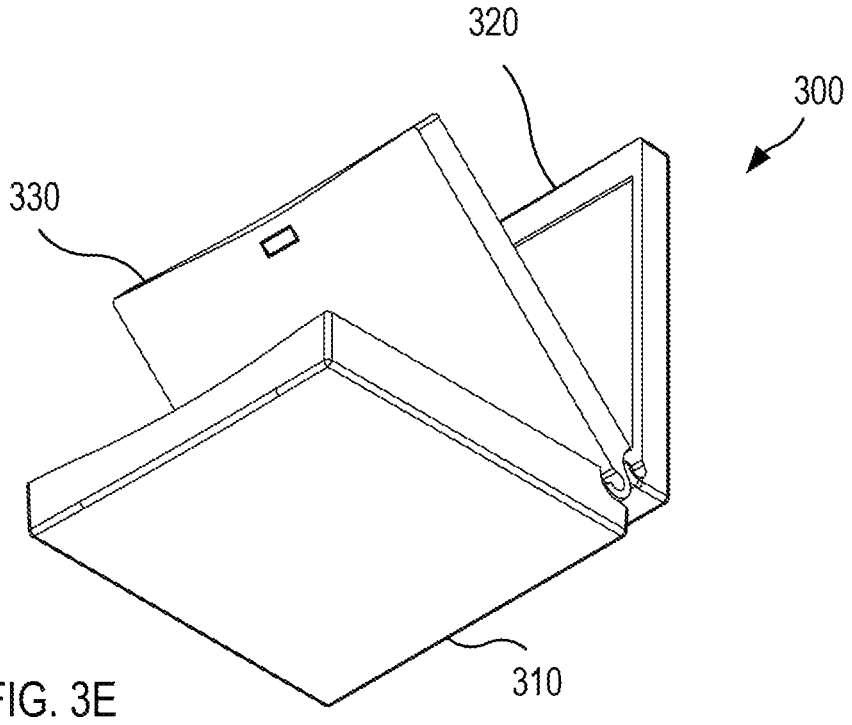
FIG. 3E shows a view of a modular case with the base, intermediate, and cover elements, according to embodiments of the present invention.

FIG. 3E depicts aspects of a modular cosmetic case 300, according to embodiments of the present invention. In this lower perspective view, the case 300 is in an assembled and open configuration. The modular cosmetic case 300 includes a base 310, a cover 320, and an insert or housing 330 (or first intermediate element) disposed between the base 310 and the cover 320.

Figure 3F:
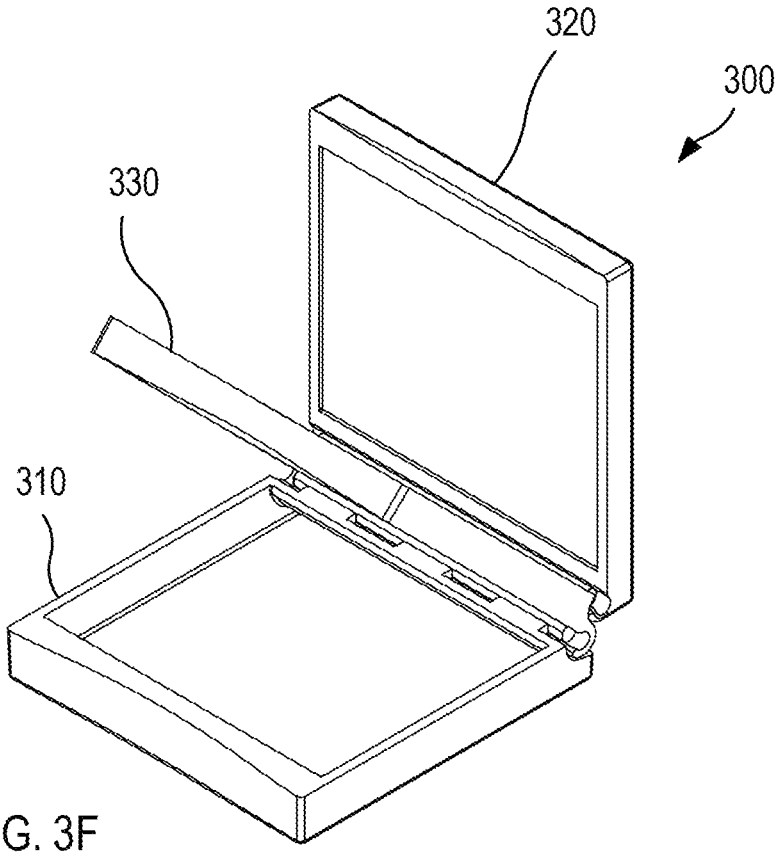
FIG. 3F shows a view of a modular case with the base, intermediate, and cover elements, according to embodiments of the present invention.

FIG. 3F depicts aspects of a modular cosmetic case 300, according to embodiments of the present invention. In this upper perspective view, the case 300 is in an assembled and open configuration. The modular cosmetic case 300 includes a base 310, a cover 320, and an insert or housing 330 (or first intermediate element) disposed between the base 310 and the cover 320.

Figure 3G:
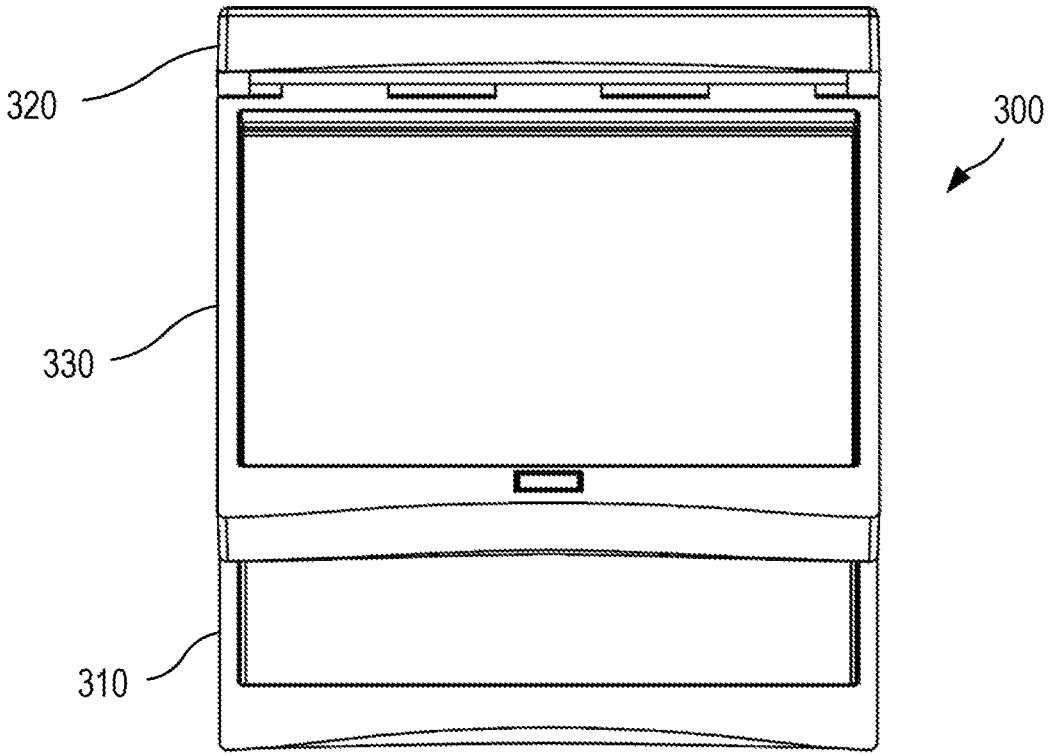
FIG. 3G shows a view of a modular case with the base, intermediate, and cover elements, according to embodiments of the present invention.

FIG. 3G depicts aspects of a modular cosmetic case 300, according to embodiments of the present invention. In this top plan view, the case 300 is in an assembled and open configuration. The modular cosmetic case 300 includes a base 310, a cover 320, and an insert or housing 330 (or first intermediate element) disposed between the base 310 and the cover 320.

Figure 3H:
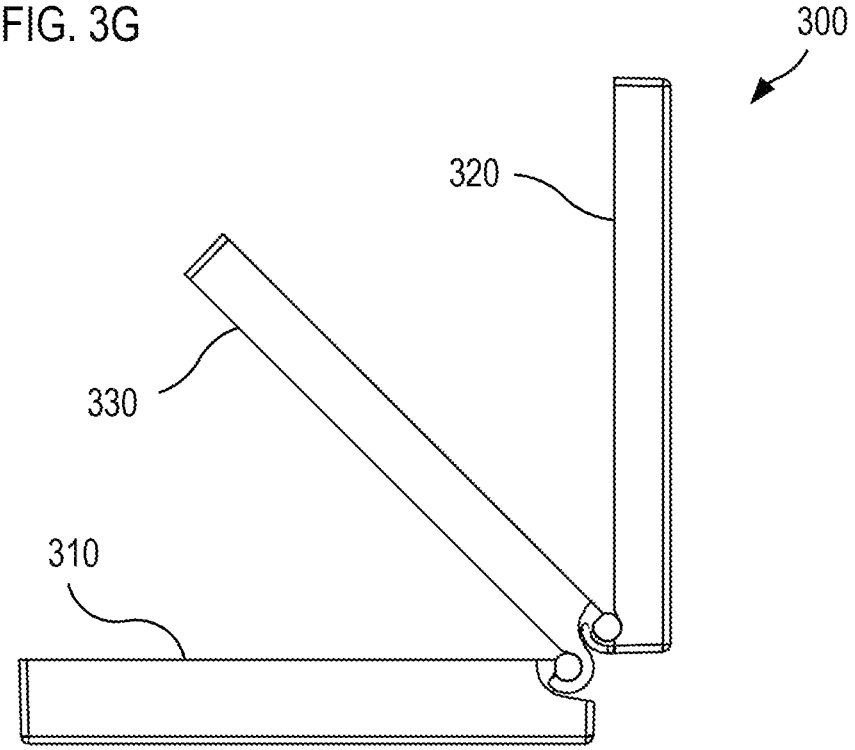
FIG. 3H shows a view of a modular case with the base, intermediate, and cover elements, according to embodiments of the present invention.

FIG. 3H depicts aspects of a modular cosmetic case 300, according to embodiments of the present invention. In this side view, the case 300 is in an assembled and open configuration. The modular cosmetic case 300 includes a base 310, a cover 320, and an insert or housing 330 (or first intermediate element) disposed between the base 310 and the cover 320.

Figure 3I:
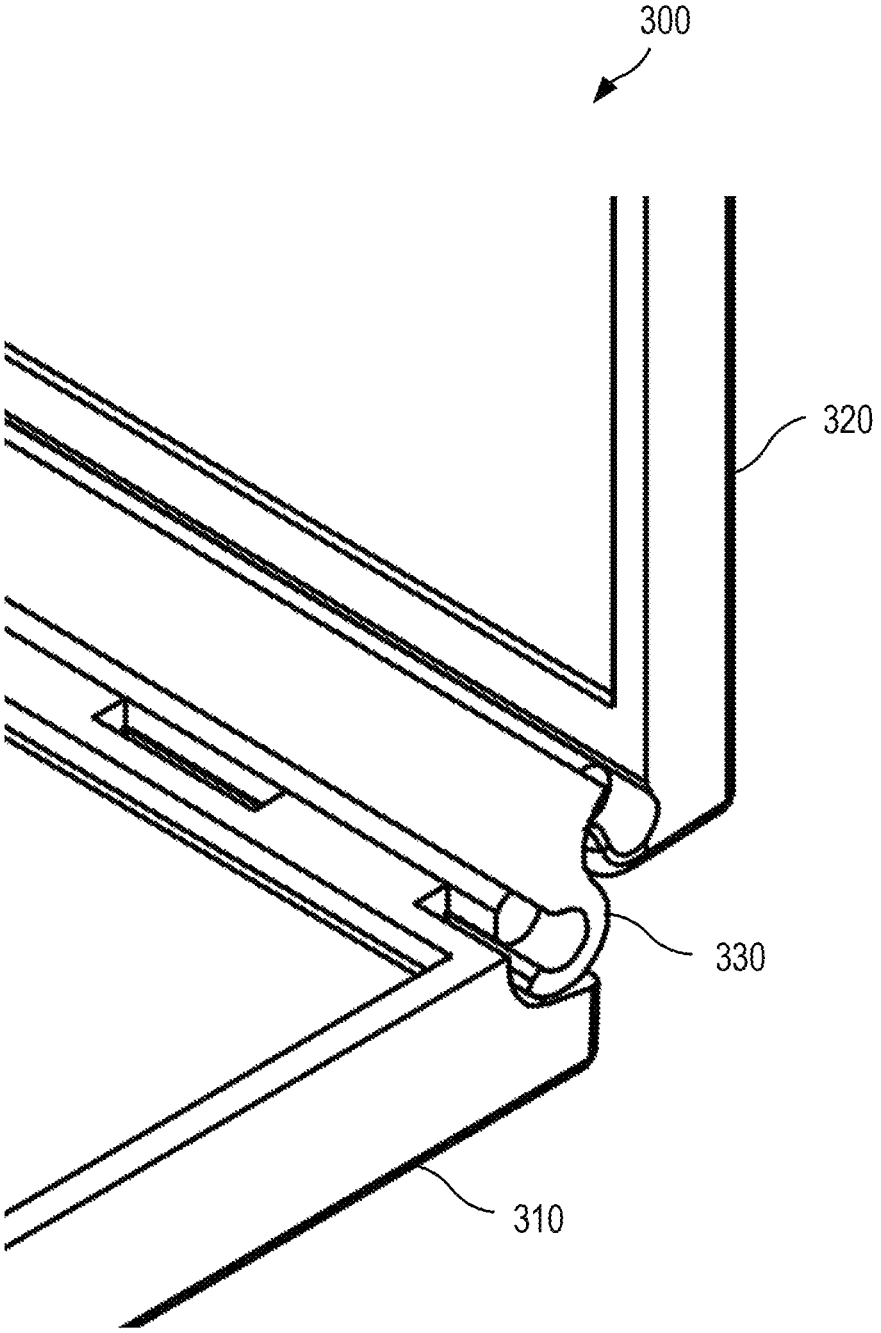
FIG. 3I shows aspects of a modular case with the base, intermediate, and cover elements, according to embodiments of the present invention.

FIG. 3I depicts aspects of a modular cosmetic case 300, according to embodiments of the present invention. In this partial upper perspective view, the case 300 is in an assembled and open configuration. The modular cosmetic case 300 includes a base 310, a cover 320, and an insert or housing 330 (or first intermediate element) disposed between the base 310 and the cover 320.

Figure 3J:
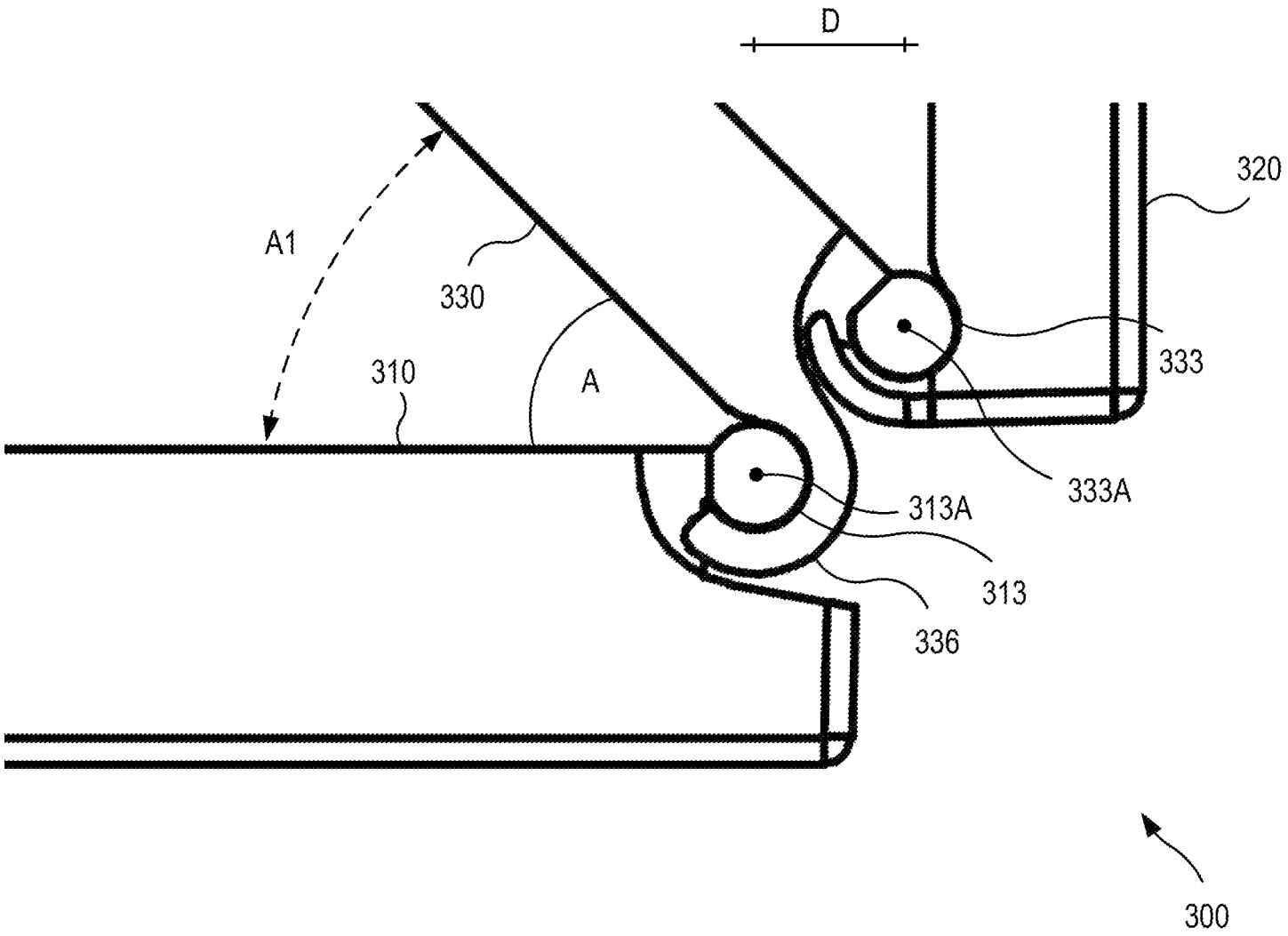
FIG. 3J shows aspects of a modular case with the base, intermediate, and cover elements, according to embodiments of the present invention.

FIG. 3J depicts aspects of a modular cosmetic case 300, according to embodiments of the present invention. In this partial side view, the case 300 is in an assembled and open configuration. The modular cosmetic case 300 includes a base 310, a cover 320, and an insert or housing 330 (or first intermediate element) disposed between the base 310 and the cover 320. As shown here, the angle A between the base 310 and the housing 330 can increase or decrease as the protuberances 336 of the housing and the protrusion 313 of the base 310 rotate relative to one another about a longitudinal axis 313A defined by the protrusion 313, as indicated by arrow A1. As angle A increases, a longitudinal axis 333A defined by protrusion 333 of the housing 330 also effectively moves along with the body of the housing. In turn, because cover 320 is attached with the protrusion 333, the cover 320 moves in an en bloc fashion along with the housing 330. This unique integrated multi-action hinge mechanism is provided by the dual operational nature of the housing 330, because the housing includes both a hinge knuckle embodied by the protuberances 336 as well as a hinge pin embodied by the protrusion 333, and in this sense the bodies of the cover, housing(s), and/or base can operate as hinge leaves. By providing a hinge knuckle element and a hinge pin element which are integrated on the same structure (here, the housing 330), the integrated multi-action hinge can spread out in a fanned arrangement as the various components rotate about multiple longitudinal axes. Relatedly, it can be seen that when angle A is zero, the longitudinal axis 313A defined by the protrusion 313 and the longitudinal axis 333A defined by protrusion 333 are in vertical alignment, as depicted in FIG. 3K-1. As shown in FIG. 3J, the axes 333A and 313A are laterally offset by a distance D, and distance D changes as angle A changes (e.g. such that the vertical alignment depicted in FIG. 3K-1 is equivalent to a distance D of zero).

FIG. 3K depicts aspects of a modular cosmetic case 300, according to embodiments of the present invention. In this side cross section view, the case 300 is in an assembled and open configuration. The modular cosmetic case 300 includes a base 310, a cover 320, and an insert or housing 330 (or first intermediate element) disposed between the base 310 and the cover 320. Aspects of the base 310, cover 320, and housing 330 are also shown in the partial side cross section views of FIGS. 3K-1 and 3K-2.

Figure 3L:
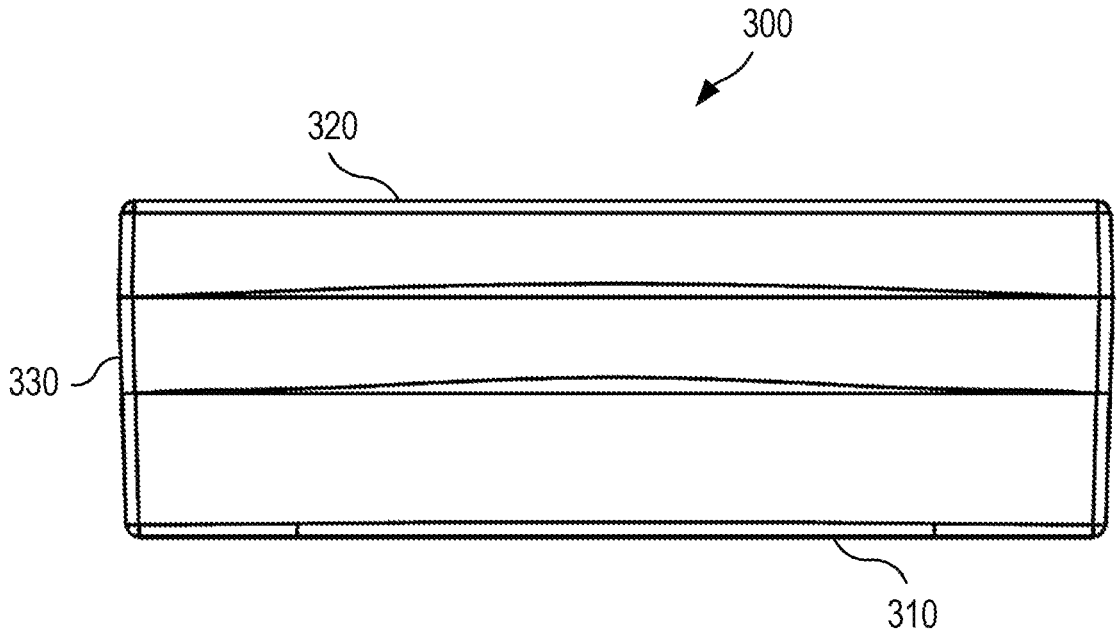
FIG. 3L shows a view of a modular case with the base, intermediate, and cover elements, according to embodiments of the present invention.

FIG. 3L depicts aspects of a modular cosmetic case 300, according to embodiments of the present invention. In this front view, the case 300 is in an assembled and closed configuration. The modular cosmetic case 300 includes a base 310, a cover 320, and an insert or housing 330 (or first intermediate element) disposed between the base 310 and the cover 320.

Figure 3M:
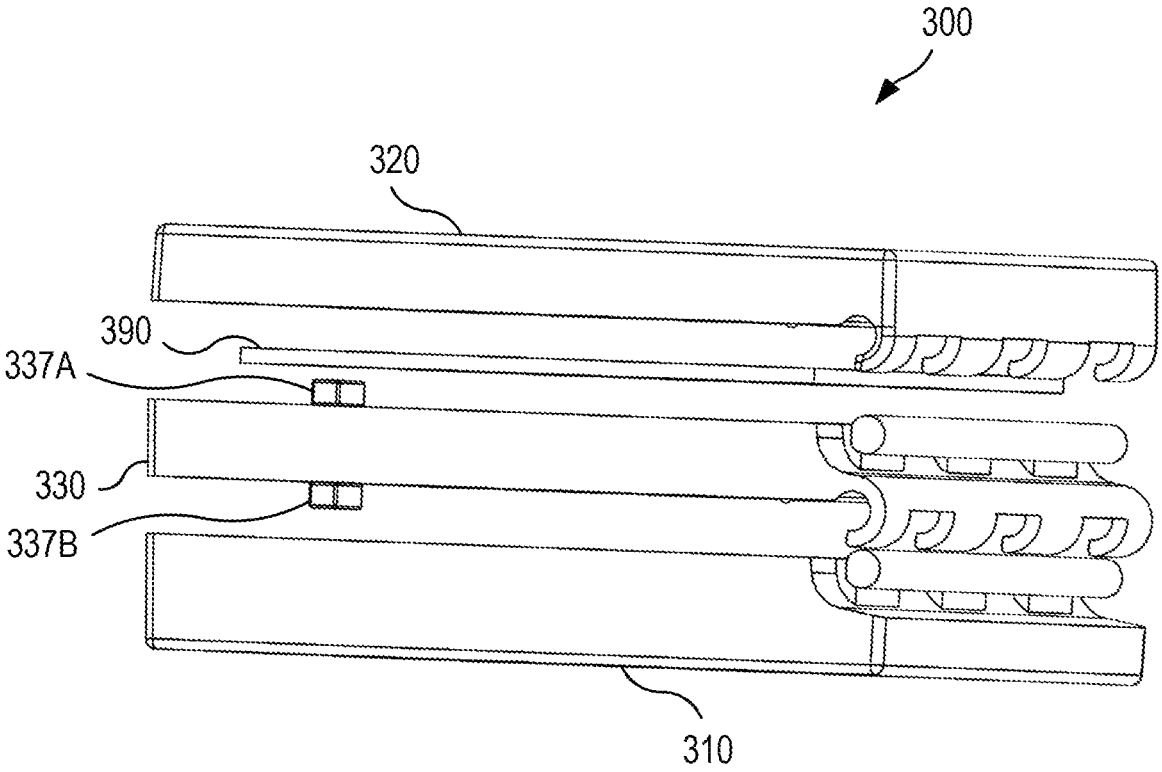
FIG. 3M shows a view of a modular case with the base, intermediate, and cover elements, according to embodiments of the present invention.

FIG. 3M depicts aspects of a modular cosmetic case 300, according to embodiments of the present invention. This exploded perspective view corresponds to an assembled and closed configuration for the case. The modular cosmetic case 300 includes a base 310, a cover 320, and an insert or housing 330 (or first intermediate element) disposed between the base 310 and the cover 320. The case also includes a mirror 390, and vertical elements such as magnets 337A and 337B. In some embodiments, the mirror 390 is coupled with the cover 320 (e.g. to the underside of the cover).

Figure 3N:
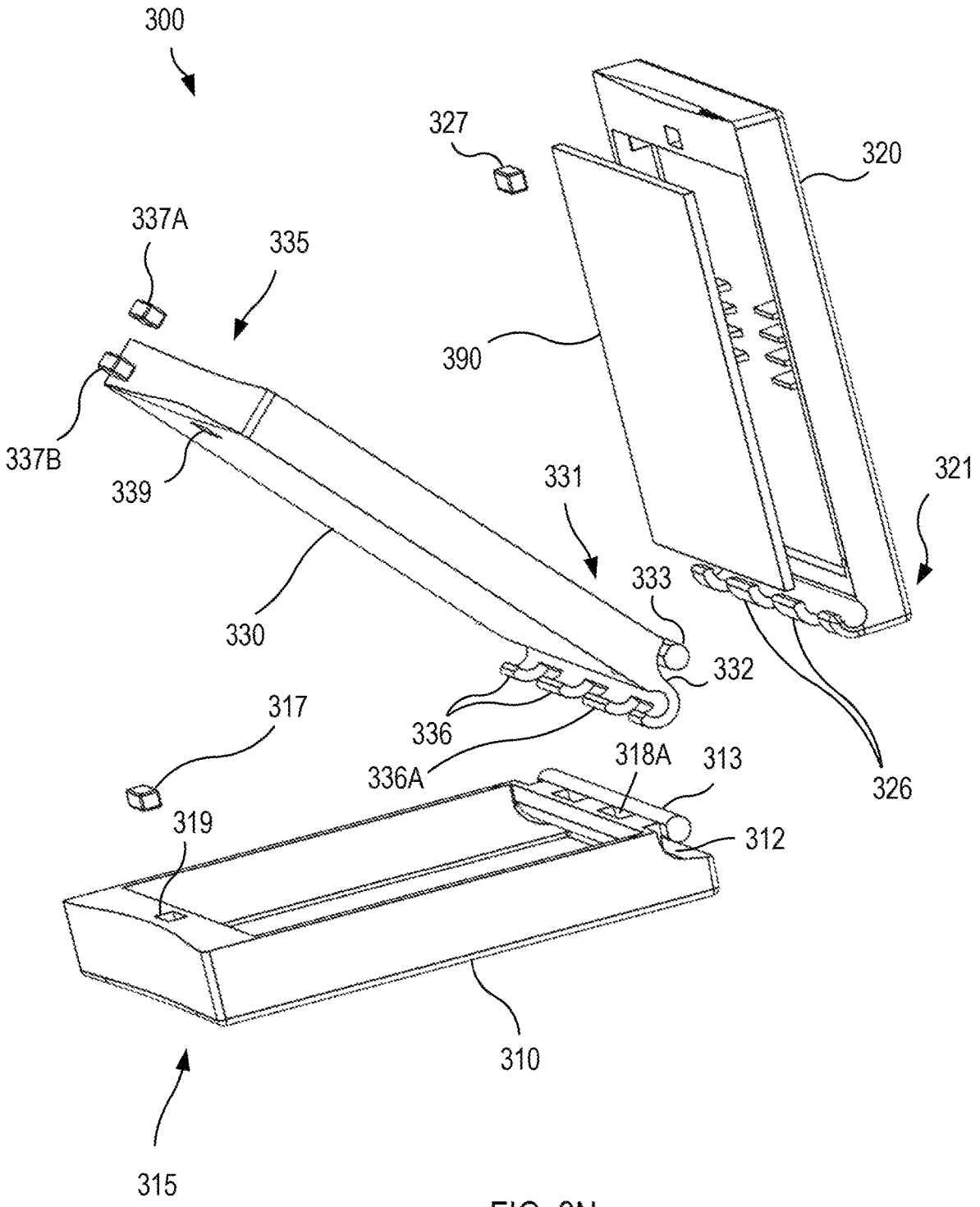
FIG. 3N shows a view of a modular case with the base, intermediate, and cover elements, according to embodiments of the present invention.

FIG. 3N depicts aspects of a modular cosmetic case 300, according to embodiments of the present invention. This exploded perspective view corresponds to an assembled and open configuration for the case. The modular cosmetic case 300 includes a base 310, a cover 320, and an insert or housing 330 (or first intermediate element) disposed between the base 310 and the cover 320. The case also includes a mirror 390, and vertical elements such as magnets 337A, 337B, 317, and 327. In some embodiments, the mirror 390 is coupled with the cover 320 (e.g. to the underside of the cover). The cover 320 includes a first lateral side 321 having a plurality of longitudinal protuberances 326. As explained elsewhere herein, the plurality of longitudinal protuberances 326 correspond with a protrusion 333 of the housing 330 and slide on a longitudinal slot 332 of the housing 330. The housing 330 includes a first lateral side 331 having a plurality of longitudinal protuberances 336. As explained elsewhere herein, the plurality of longitudinal protuberances 336 correspond with a protrusion 313 of the base 310 and slide on a longitudinal slot 312 of the base 310. A second lateral side 335 of the housing 330 includes a central perforation 339 having at least one vertical element 337B. In some cases, the vertical element 337B can include a magnet. As shown in the view depicted here, perforation 339 can be a lower perforation and vertical element 337B can be a lower vertical element. A second lateral side 315 of the base 310 includes a central perforation 319 and/or at least one vertical element 317. In some cases, the vertical element 317 can include a magnet. A second lateral side 325 of the cover 320 includes a central perforation 329 and/or at least one vertical element 327. In some cases, the vertical element 327 can include a magnet.

As explained elsewhere herein, when the case 300 is in an open configuration, engagement between protuberances of one case element (e.g. housing or cover) and slits of an adjacent case element (e.g. housing or base) operates to prevent or inhibit the adjacent case elements from slidingly disengaging from each other. For example, with reference the unassembled view provided by FIG. 3N, if the case were in an assembled configuration and the housing 330 and base 310 were rotated relative to one another (see e.g. FIG. 3J) then for instance a protuberance 336A of the housing 330 would insert into a corresponding slit 318A of the base 310, and thereby prevent or inhibit the housing and the base from slidingly disengaging from one another. Additional aspects of such functionality are described herein with reference to FIG. 7. It can be seen in FIG. 3N that such engagement could involve insertion of multiple protuberances of cover 320 into multiple corresponding slits of housing 330, and/or insertion of multiple protuberances of housing 330 into multiple corresponding slits of base 310.

Figure 3O:
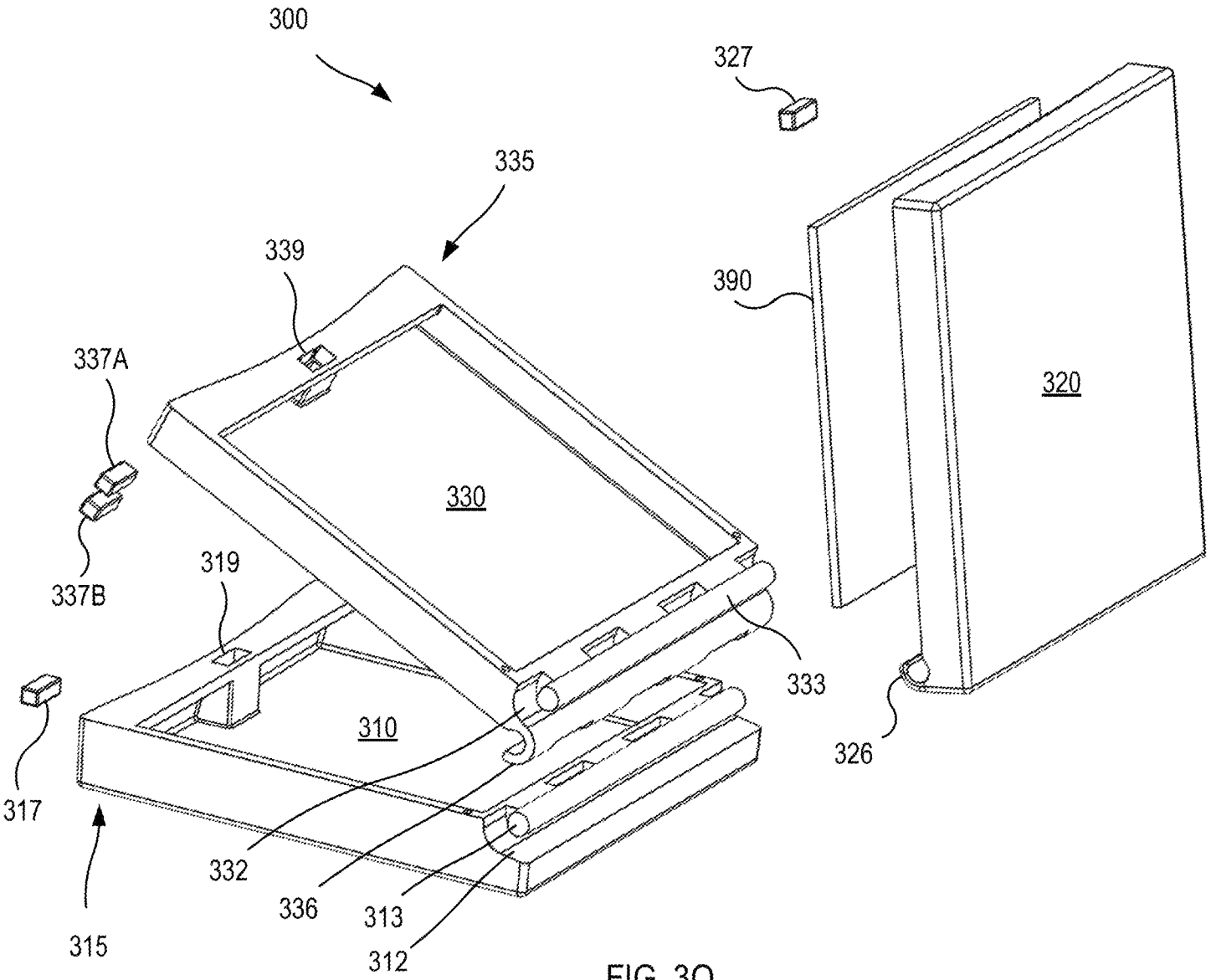
FIG. 3O shows a view of a modular case with the base, intermediate, and cover elements, according to embodiments of the present invention.

FIG. 3O depicts aspects of a modular cosmetic case 300, according to embodiments of the present invention. This exploded perspective view corresponds to a partially assembled and open configuration for the case. The modular cosmetic case 300 includes a base 310, a cover 320, and an insert or housing 330 (or first intermediate element) disposed between the base 310 and the cover 320. The case also includes a mirror 390, and vertical elements such as magnets 337A, 337B, 317, and 327. In some embodiments, the mirror 390 is coupled with the cover 320 (e.g. to the underside of the cover). The cover 320 includes a first lateral side having a plurality of longitudinal protuberances 326. As explained elsewhere herein, the plurality of longitudinal protuberances 326 correspond with a protrusion 333 of the housing 330 and slide on a longitudinal slot 332 of the housing 330. The housing 330 includes a first lateral side having a plurality of longitudinal protuberances 336. As explained elsewhere herein, the plurality of longitudinal protuberances 336 correspond with a protrusion 313 of the base 310 and slide on a longitudinal slot 312 of the base 310. A second lateral side 335 of the housing 330 includes a central perforation 339 having at least one vertical element 337A. In some cases, the vertical element 337A can include a magnet. As shown in the view depicted here, perforation 339 can be an upper perforation and vertical element 337A can be an upper vertical element. A second lateral side 315 of the base 310 includes a central perforation 319 and/or at least one vertical element 317. In some cases, the vertical element 317 can include a magnet. A second lateral side of the cover 320 includes a central perforation and/or at least one vertical element 327. In some cases, the vertical element 327 can include a magnet.

Figure 4A:
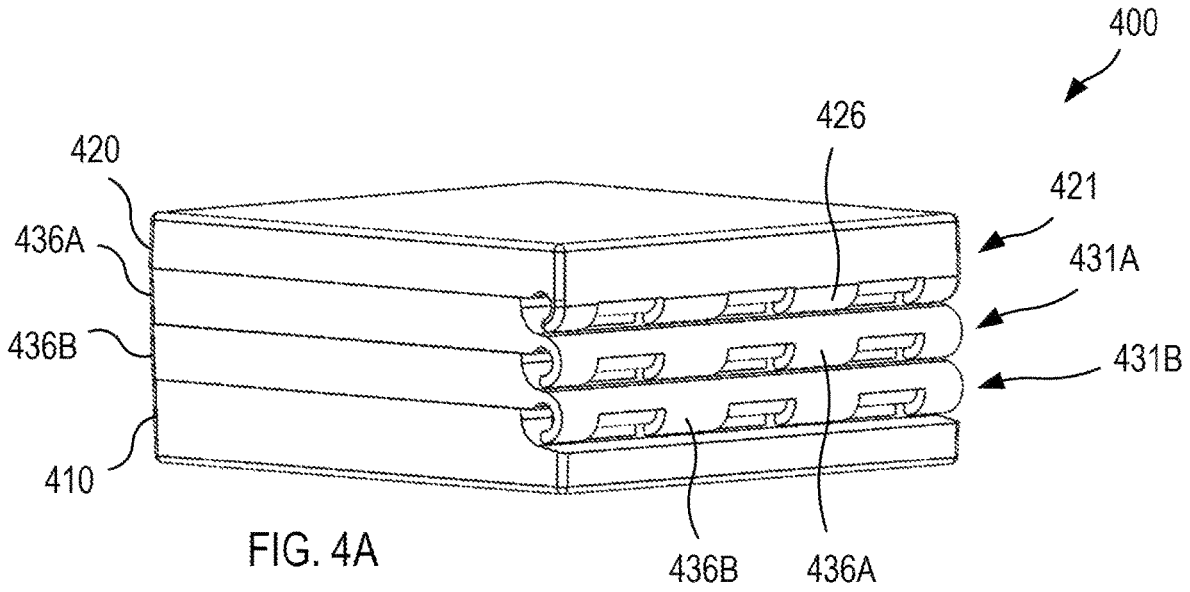
FIGS. 4A and 4B show a closed and open modular case with the base, first housing, second housing, and cover elements, according to embodiments of the present invention.

FIG. 4A depicts aspects of a modular cosmetic case 400, according to embodiments of the present invention. In this view, the case 400 is in an assembled and closed configuration. The modular cosmetic case 400 includes a base 410, a cover 420, and two inserts or housings 430A, 430B (or first intermediate and second elements) disposed between the base 410 and the cover 420. The cover 420 includes a first lateral side 421 having a plurality of longitudinal protuberances 426. As explained elsewhere herein, the plurality of longitudinal protuberances 426 correspond with a protrusion of the upper or first housing 430A and slide on a longitudinal slot of the housing 430A. The first housing 430A includes a first lateral side 431A having a plurality of longitudinal protuberances 436A. As explained elsewhere herein, the plurality of longitudinal protuberances 436A correspond with a protrusion of the lower or second housing 430B and slide on a longitudinal slot of the lower or second housing 430B. The second housing 430B includes a first lateral side 431B having a plurality of longitudinal protuberances 436B. As explained elsewhere herein, the plurality of longitudinal protuberances 436B correspond with a protrusion of the base 410 and slide on a longitudinal slot of the base 410.

Figure 4B:
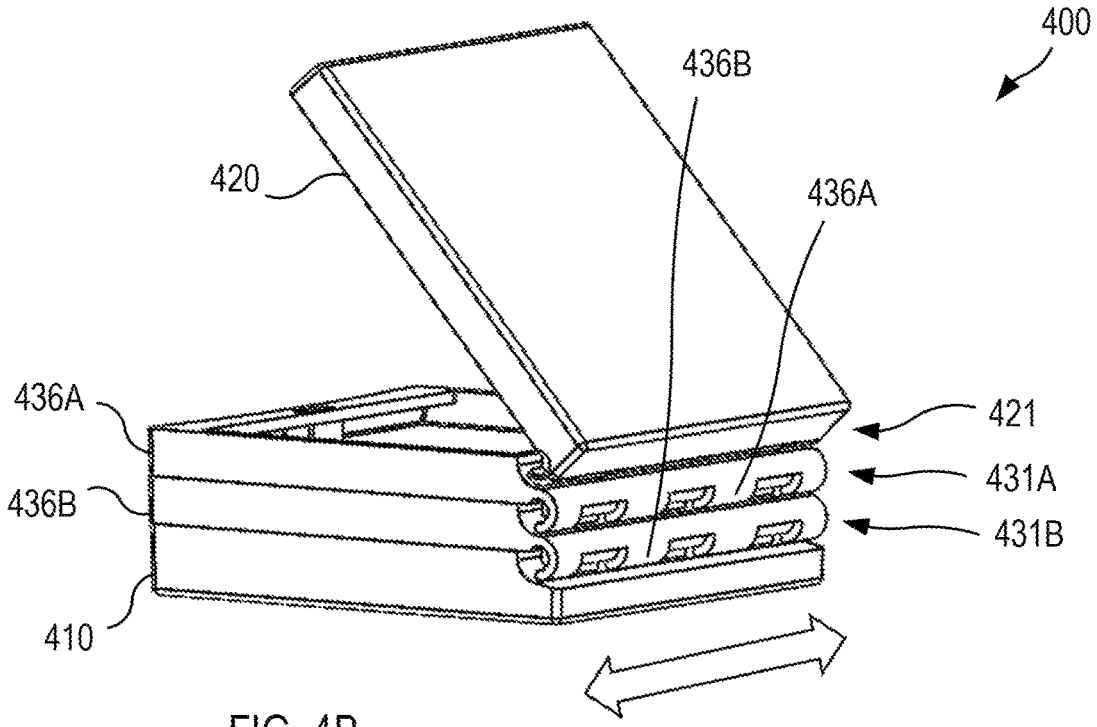

FIG. 4B depicts aspects of a modular cosmetic case 400, according to embodiments of the present invention. In this view, the case 400 is in an assembled and partially open configuration. The modular cosmetic case 400 includes a base 410, a cover 420, and two inserts or housings 430A, 430B (or first intermediate and second elements) disposed between the base 410 and the cover 420. The cover 420 includes a first lateral side 421 having a plurality of longitudinal protuberances. As explained elsewhere herein, the plurality of longitudinal protuberances correspond with a protrusion of the upper or first housing 430A and slide on a longitudinal slot of the housing 430A. The first housing 430A includes a first lateral side 431A having a plurality of longitudinal protuberances 436A. As explained elsewhere herein, the plurality of longitudinal protuberances 436A correspond with a protrusion of the lower or second housing 430B and slide on a longitudinal slot of the lower or second housing 430B. The second housing 430B includes a first lateral side 431B having a plurality of longitudinal protuberances 436B. As explained elsewhere herein, the plurality of longitudinal protuberances 436B correspond with a protrusion of the base 410 and slide on a longitudinal slot of the base 410.

Figure 5:
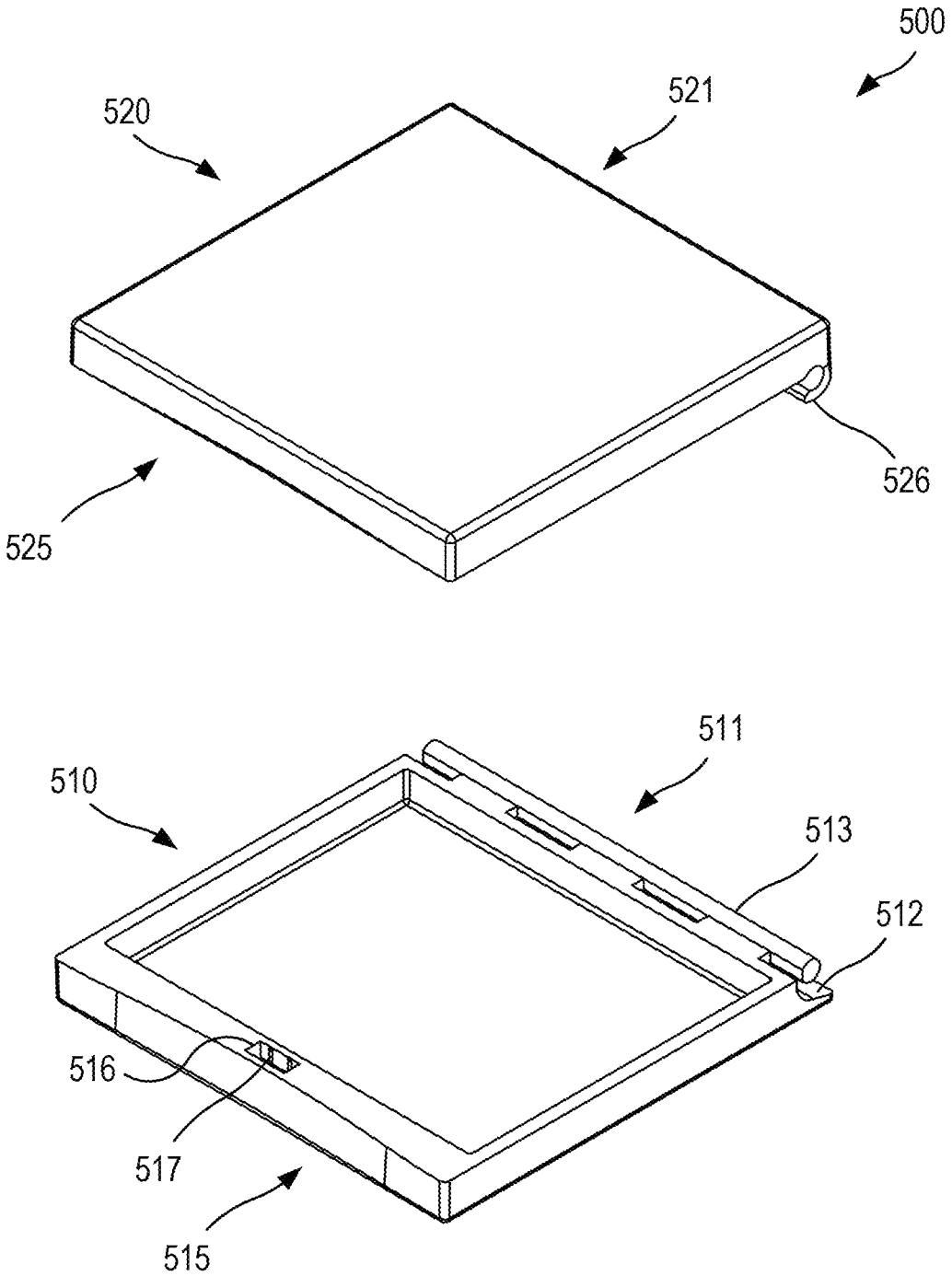
FIG. 5 shows a view of a modular case with the base and cover elements, according to embodiments of the present invention.

FIG. 5 depicts aspects of a modular cosmetic case 500, according to embodiments of the present invention. The modular cosmetic case 500 can be used for a wide variety of cosmetics, including for example pasty products. As shown here, modular cosmetic case 500 includes a base 510 having a first lateral side 511 (e.g. rear of the base) and a second lateral side 515 (e.g. front of the base) opposite the first lateral side 511. The first lateral side 511 includes a longitudinal slot 512 and a protrusion 513 on the longitudinal slot 512. The second lateral side 515 includes a central perforation 516 having at least one vertical element 517. In some cases, a vertical element 517 can include a magnet. In some cases, a vertical element can include a mechanical crimping mechanism.

Modular cosmetic case 500 also includes a cover 520 having a first lateral side 521 and a second lateral side 525 opposite the first lateral side 521. The first lateral side 521 includes a plurality of longitudinal protuberances 526 corresponding to the protrusion 513 of base 510. The second lateral side 525 includes a central perforation (not visible) corresponding to the at least one vertical element 517 of base 510. Corresponding magnets or mechanical crimping mechanisms can be provided on both the cover and the base, so as to provide a closure mechanism or latch for securing the second lateral side 525 of the cover and the second lateral side 515 of the base together.

Figure 6:
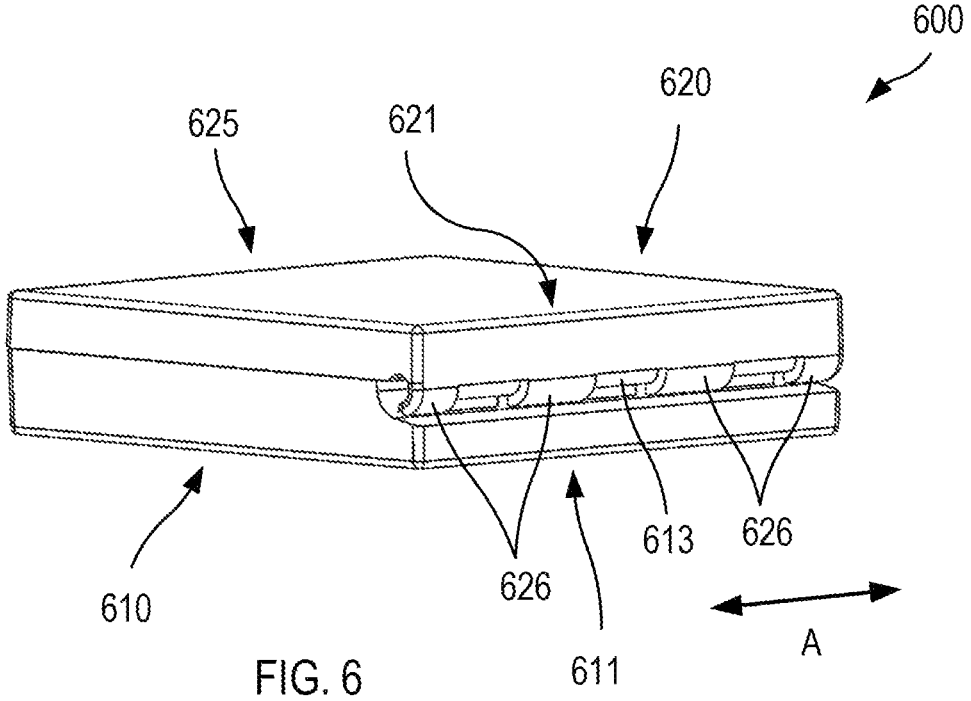
FIG. 6 shows a view of a modular case with the base and cover elements, according to embodiments of the present invention.

In use, a base can be engaged with a cover, as depicted in FIG. 6. Here, the case 600 is in a closed configuration. The cover 620 includes a first lateral side 621 (e.g. rear) having a plurality of longitudinal protuberances 626 which correspond to the protrusion 613 of base 610. The cover 620 also includes a second lateral side 625 (e.g. front) opposite the first lateral side 621. To couple the base 610 and cover 620 with one another at the rear of the case 600, the first lateral side 611 of the base and the first lateral side 621 of the cover can be slidingly engaged, as indicated by arrow A.

Figure 7:
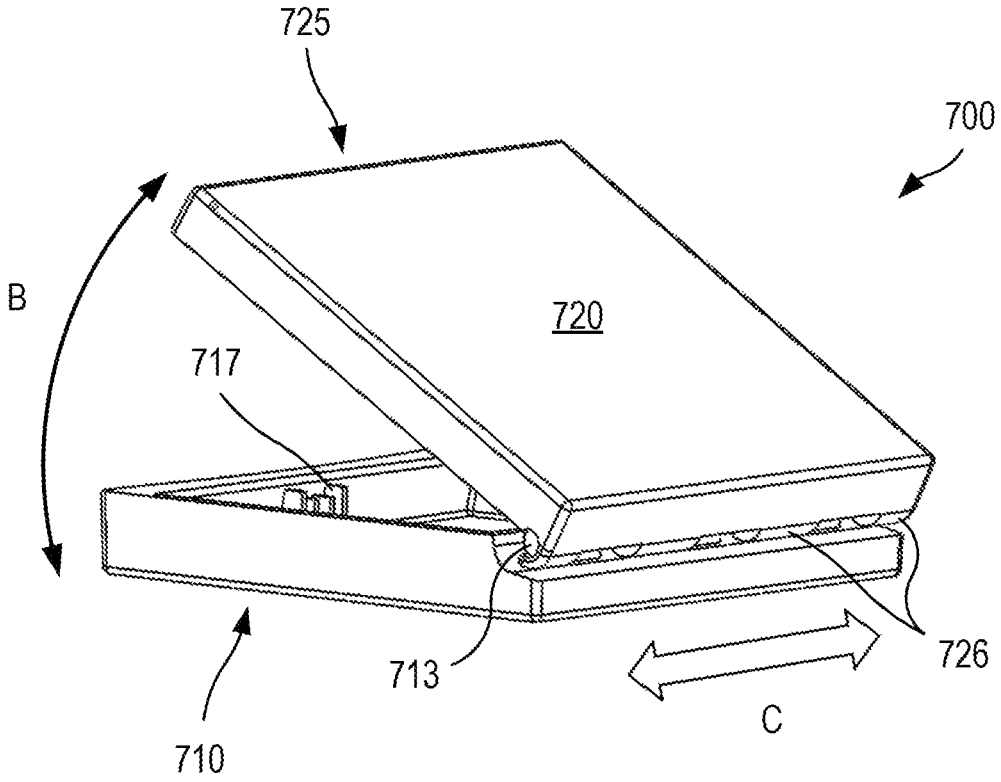
FIG. 7 shows a closed and open modular case with the base and cover elements, according to embodiments of the present invention.

FIG. 7 depicts an assembled case 700, in an open configuration. As shown here, the engagement between the longitudinal protuberances 726 of the cover 720 and the protrusion 713 of base 710 provides a hinge mechanism which enables the cover 720 and the base 710 to move relative to one another throughout an angle of rotation, as indicated by arrow B. The second lateral side 725 (e.g. front) of the cover 720 includes a central perforation (not visible) corresponding to the at least one vertical element 717 of base 710. When the case 700 is in an open configuration, the base 710 and cover 720 are prevented or inhibited from slidingly disengaging from one another (i.e. base and cover cannot move relative to one another along arrow C) due to the engagement of the protuberances 726 of the cover 720 and the slits of the base 710, as explained elsewhere herein (e.g. with reference to FIG. 3N).

Figure 8A:
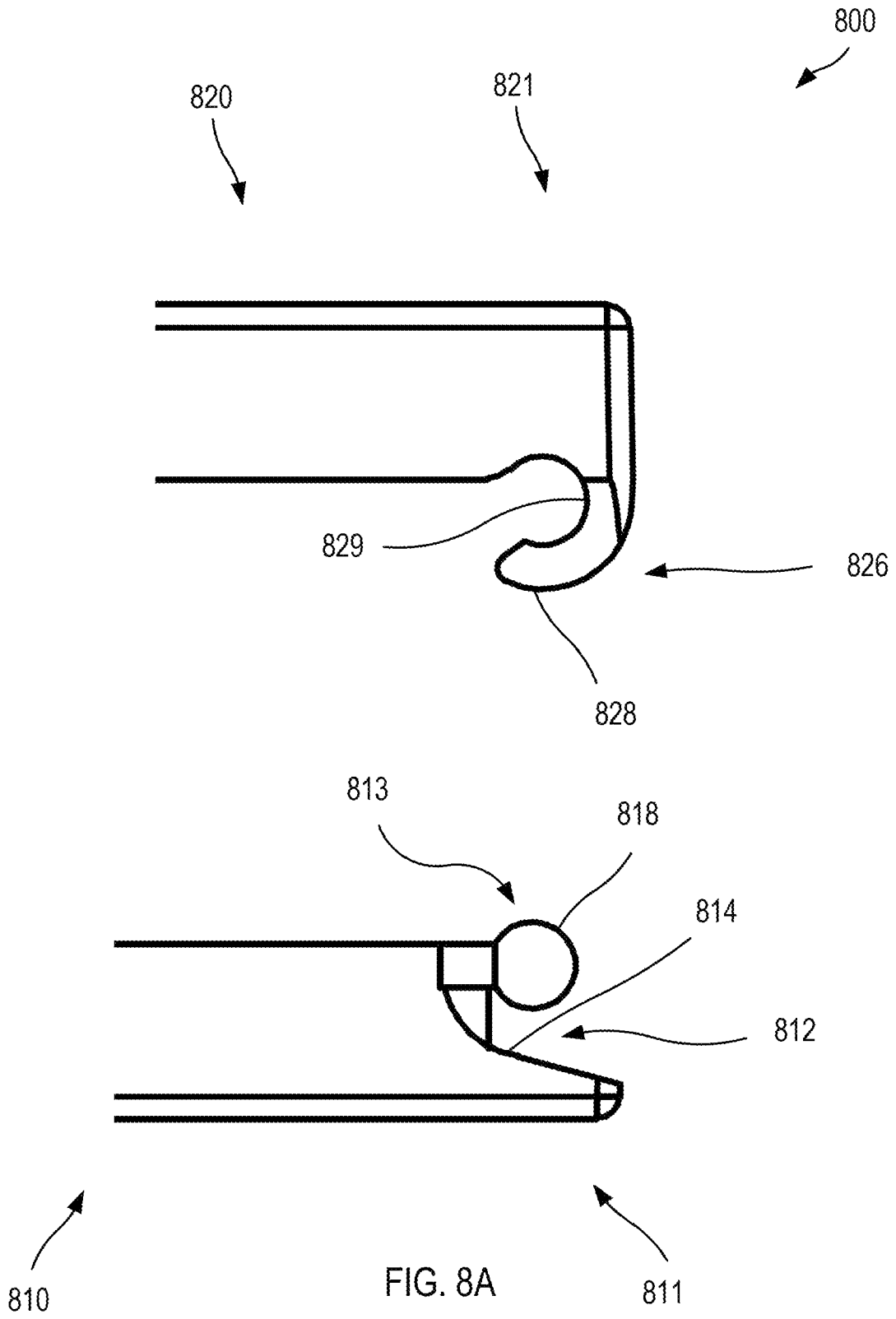
FIG. 8A shows aspects of a modular case with the base and cover elements, according to embodiments of the present invention.

FIG. 8A provides a side view of a partial case 800 in an unassembled configuration. As shown here, the first lateral side 811 (e.g. rear) of base 810 includes a longitudinal slot 812 and a protrusion 813, and the first lateral side 821 (e.g. rear) of cover 820 includes protuberances 826. The longitudinal slot 812 has a concave surface 814. A protuberance 826 has a convex surface 828. When base 810 and cover 820 are slidingly engaged or disengaged with one another, concave surface 814 and convex surface 828 slide along relative to one another. It can also be seen that protrusion 813 of base 810 has a convex surface 818, and protuberances 826 of cover 820 have a concave surface 829. When base 810 and cover 820 are slidingly engaged or disengaged with one another, concave surface 829 and convex surface 818 slide along relative to one another.

Figure 8B:
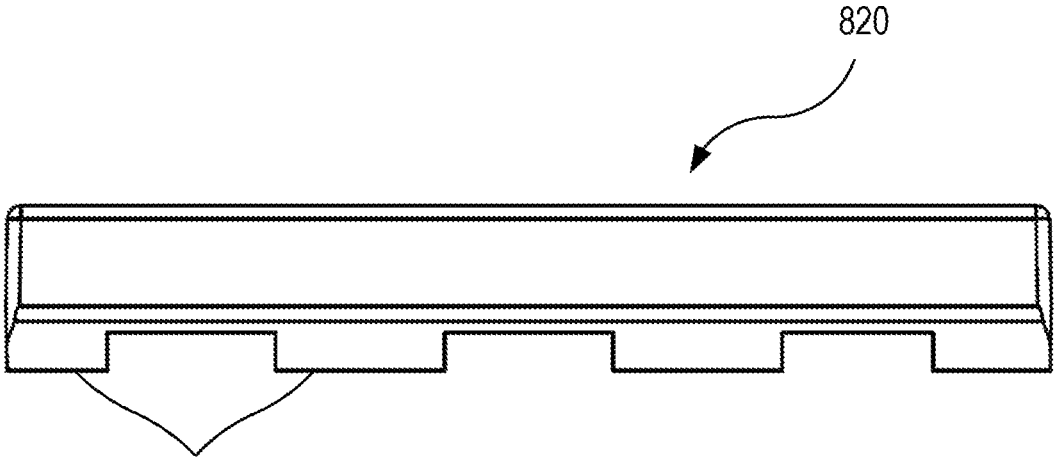
FIGS. 8B, 8C, and 8D show aspects of a modular case with the base and cover elements, according to embodiments of the present invention.
Figure 8C:
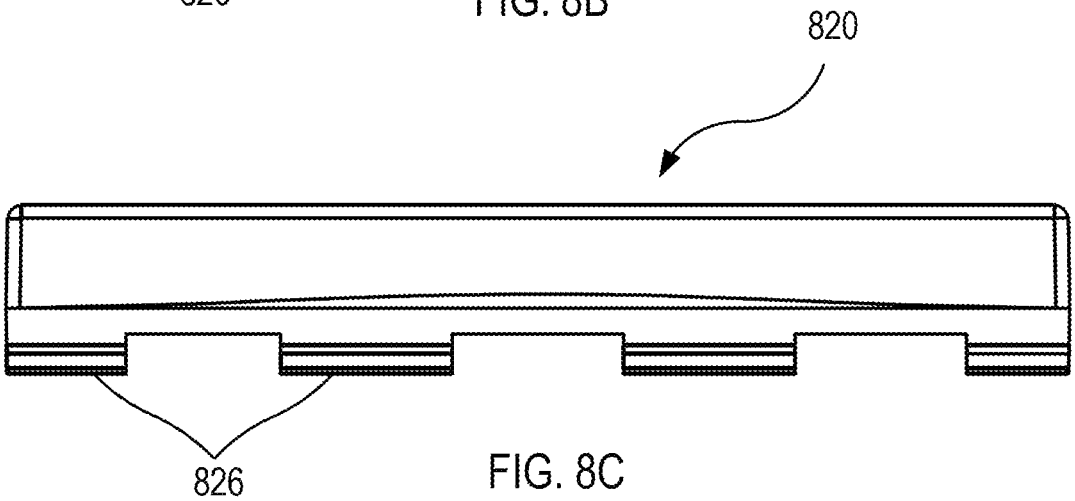
Figure 8D:
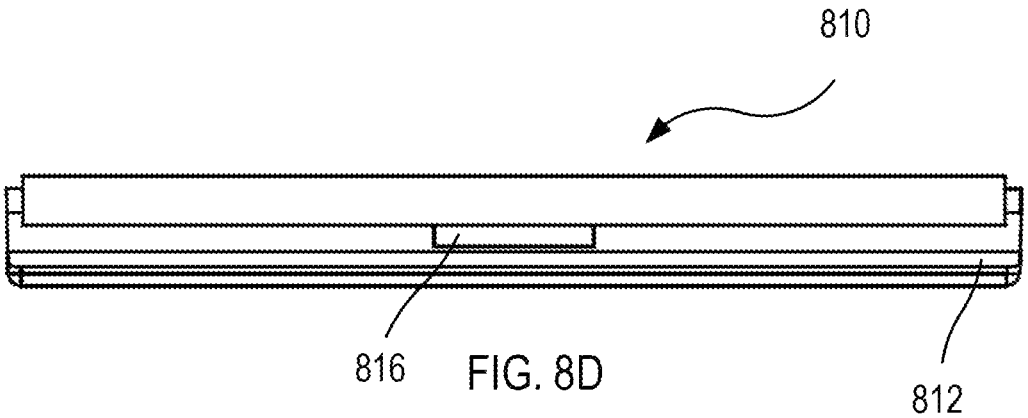

FIG. 8B provides a rear view of a cover 820 of a case, according to embodiments of the present invention. As shown here, cover 820 includes multiple protuberances 826. FIG. 8C provides a front view of a cover 820 of a case, according to embodiments of the present invention. As shown here, cover 820 includes multiple protuberances 826. FIG. 8D provides a rear view of a base 810 of a case, according to embodiments of the present invention. As shown here, cover 810 includes a protrusion 813 that is coupled with a longitudinal slot 812 via a post 816.

Figure 8E:
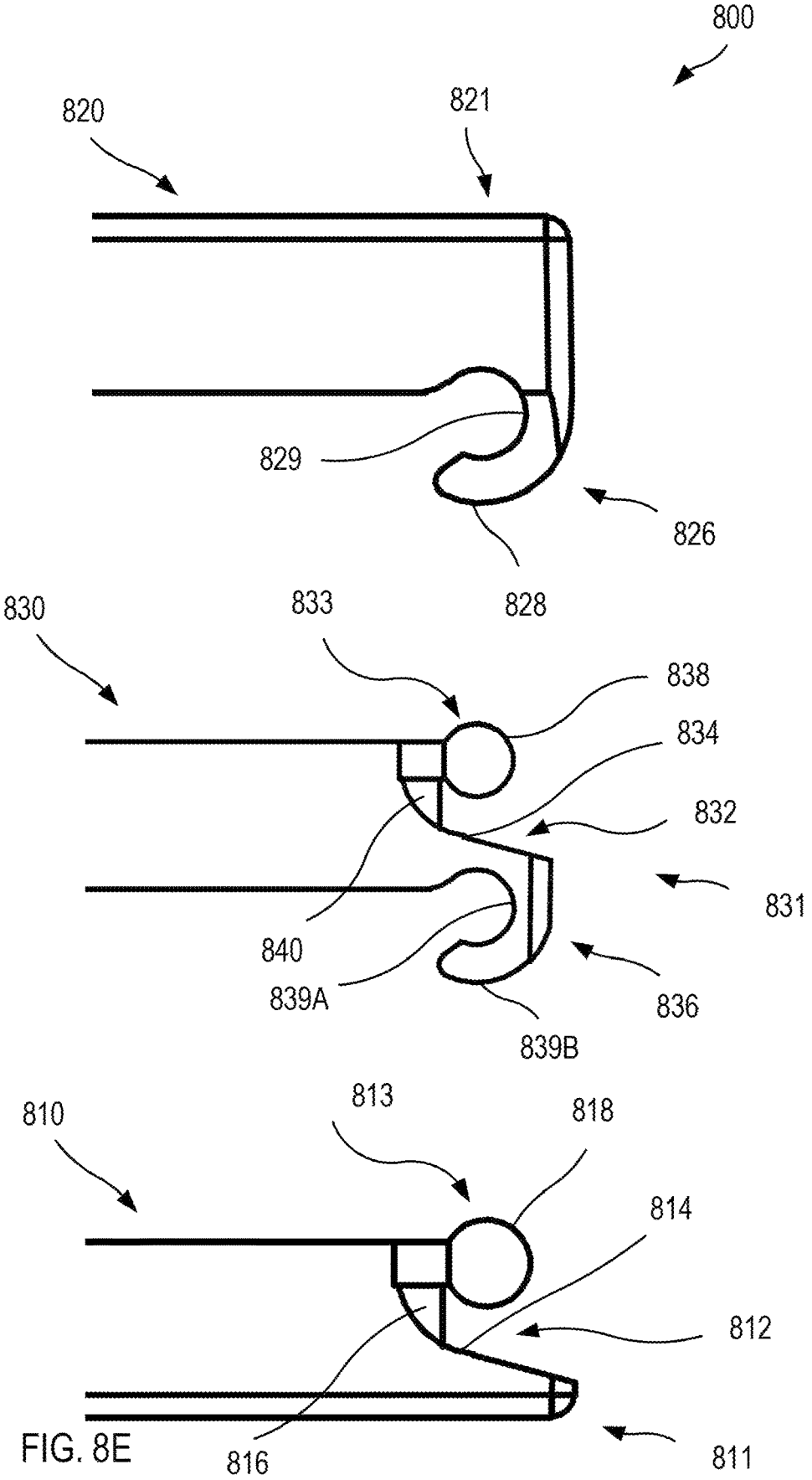
FIG. 8E shows aspects of a modular case with the base, intermediate, and cover elements, according to embodiments of the present invention.

FIG. 8E provides a side view of a partial case 800 in an unassembled configuration. As shown here, the first lateral side 811 (e.g. rear) of base 810 includes a longitudinal slot 812 and a protrusion 813 coupled with the slot 812 via at least one post 816. The longitudinal slot 812 has a concave surface 814. The protrusion 813 of base 810 has a convex surface 818. The first lateral side 831 (e.g. rear) of housing 830 includes a longitudinal slot 832, a protrusion 833 coupled with the slot 832 via at least one post 840, and at least one protuberance 836. The longitudinal slot 832 has a concave surface 834. The protrusion 833 of housing 830 has a convex surface 838. The protuberance 836 of housing 830 has a concave surface 839A and a convex surface 839B. The first lateral side 821 (e.g. rear) of cover 820 includes one or more protuberances 826. A protuberance 826 has a convex surface 828 and a concave surface 829. When base 810 and housing 830 are slidingly engaged or disengaged with one another, concave surface 814 and convex surface 839B slide along relative to one another, and concave surface 839A and convex surface 818 slide along relative to one another. When housing 830 and cover 820 are slidingly engaged or disengaged with one another, concave surface 834 and convex surface 828 slide along relative to one another, and concave surface 829 and convex surface 838 slide along relative to one another.

Figure 9:
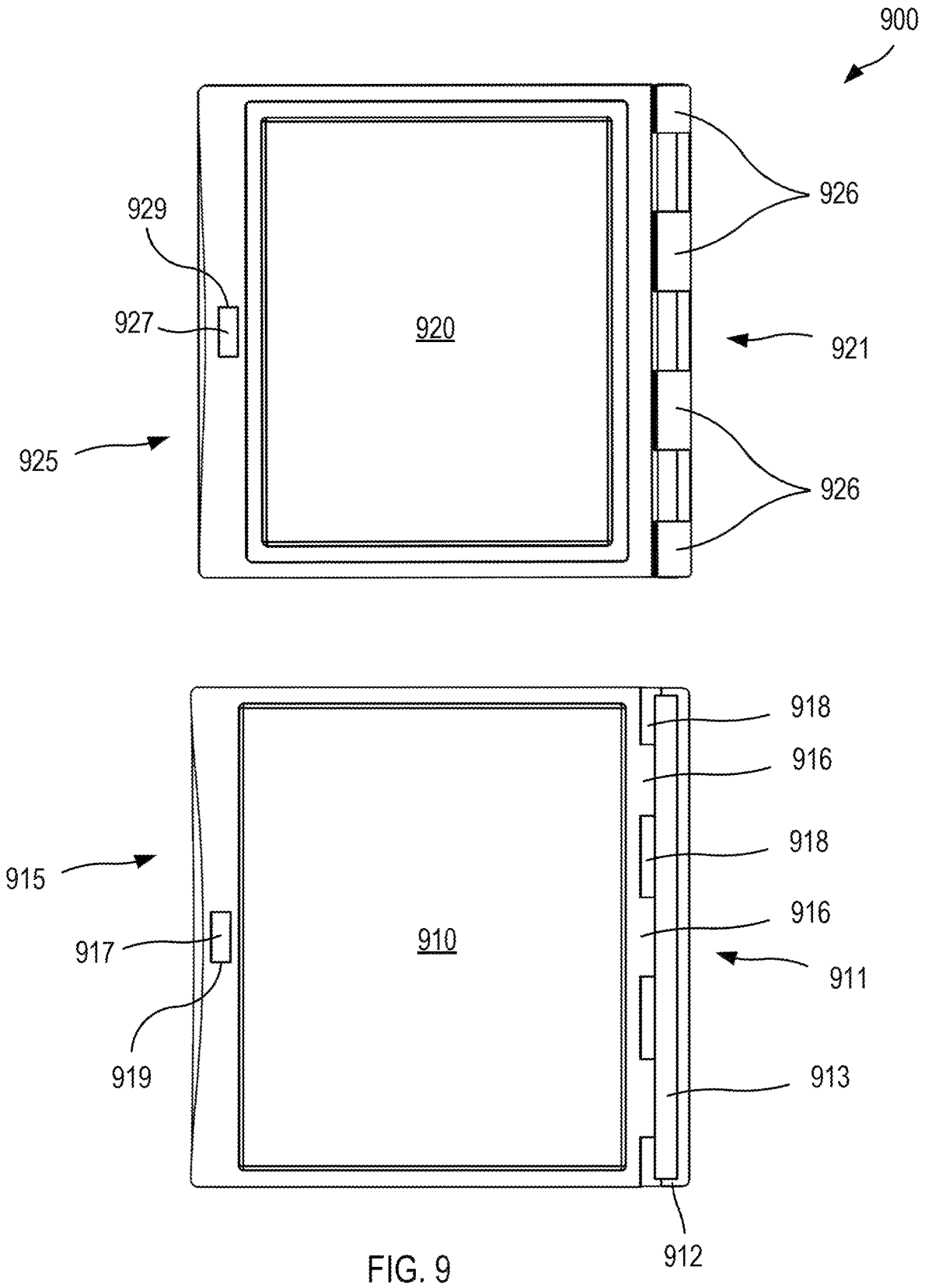
FIG. 9 shows a view of a modular case with the base and cover elements, according to embodiments of the present invention.

FIG. 9 provides an underside view of a cover 920 and a topside view of a base 910, which together can be coupled with one another to provide a case 900. Hence in FIG. 9, the case 900 is shown in an unassembled configuration. As shown here, the first lateral side 911 (e.g. rear) of base 911 includes a longitudinal slot 912 and a protrusion 913, and the first lateral side 921 (e.g. rear) of cover 920 includes protuberances 926. The longitudinal slot 912 has a concave surface, and a protuberance 926 has a convex surface. When base 910 and cover 920 are slidingly engaged or disengaged with one another, the concave surface and convex surfaces slide along relative to one another. When the case 900 is in an open configuration, the base 910 and cover 920 are prevented or inhibited from slidingly disengaging from one another (i.e. base and cover cannot move relative to one another along axis defined by protrusion 913) due to the engagement of the protuberances 926 of the cover 920 and the slits 918 of the base 910 (e.g. as a protuberance 926 advances into slit 918, which may be between adjacent posts 916 or adjacent to a single post 916), as explained elsewhere herein. As shown here, cover 920 includes a central perforation 929 having a vertical element 927. Likewise, base 910 includes a central perforation 919 having a vertical element 917. In some embodiments, vertical element 927 is a magnet, and vertical element 927 is also a magnet. The magnets attract one another, so as to keep the case 900 in a closed configuration when the respective second lateral sides 925, 915 (e.g. front sides) are closed together or brought into proximity with one another.

Figure 10A:
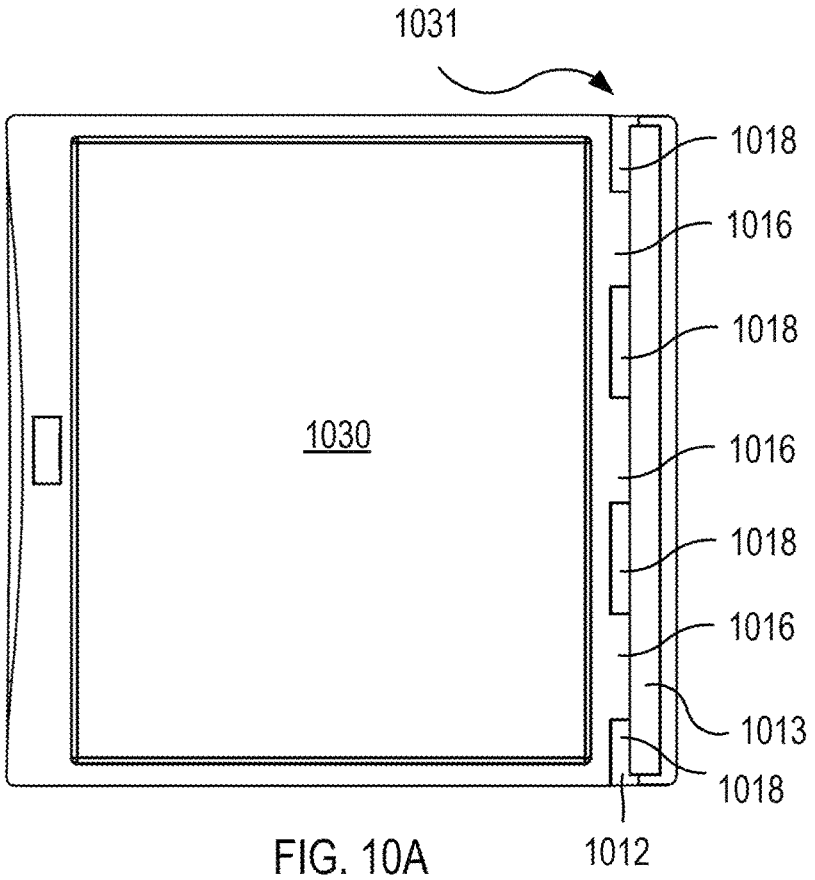
FIG. 10A shows a view of a modular case housing, according to embodiments of the present invention.
Figure 10B:
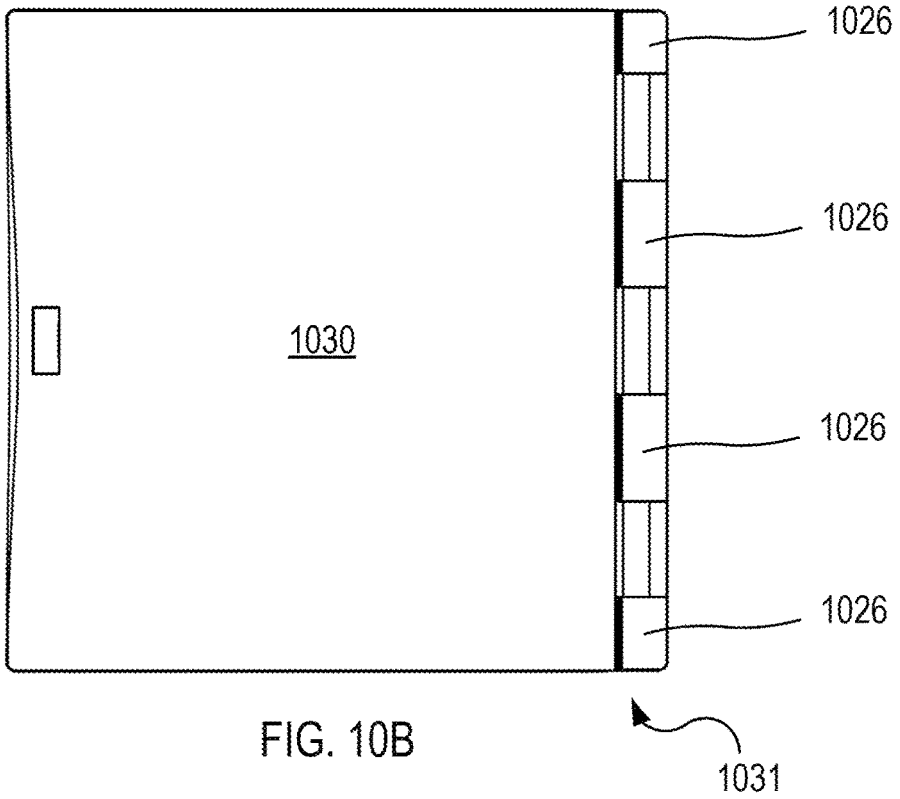
FIG. 10B shows a view of a modular case housing, according to embodiments of the present invention.

FIG. 10A provides a topside view of a housing 1030 and FIG. 10B provides an underside view of the housing 1030. As shown in FIG. 10A, a first lateral side 1031 (e.g. rear) of housing 1030 includes a longitudinal slot 1012 and a protrusion 1013 that is coupled with the longitudinal slot 1012 via one or more posts 1016. In between and/or adjacent to the posts 1016, the housing 1030 also includes one or more slits 1018. As shown in FIG. 10B, a first lateral side 1031 (e.g. rear) of housing 1030 includes one or more protuberances 1026. A case may include any number of housings 1030 disposed between a cover and a base.

Figure 11A:
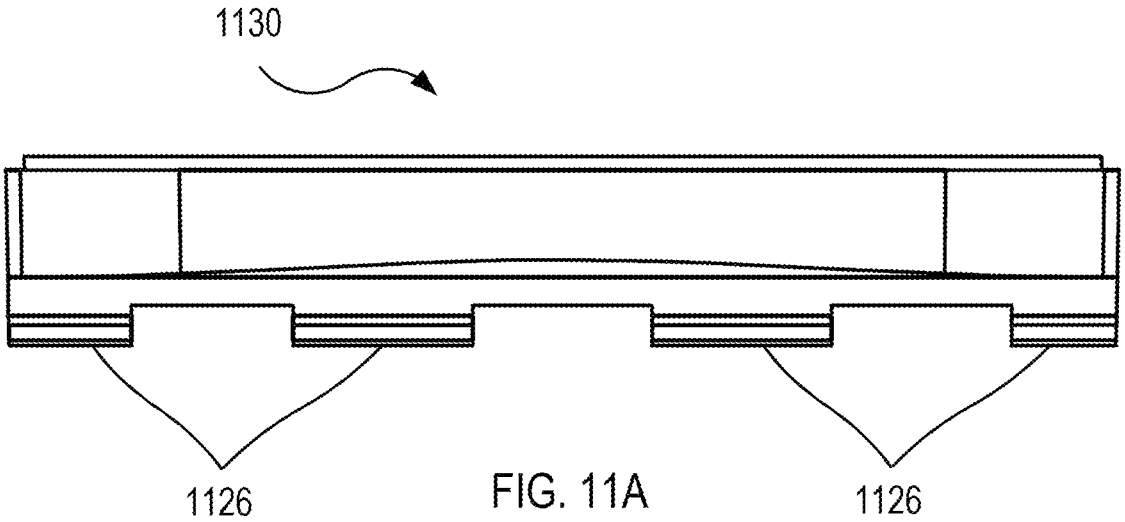
FIG. 11A shows a view of a modular case housing, according to embodiments of the present invention.
Figure 11B:
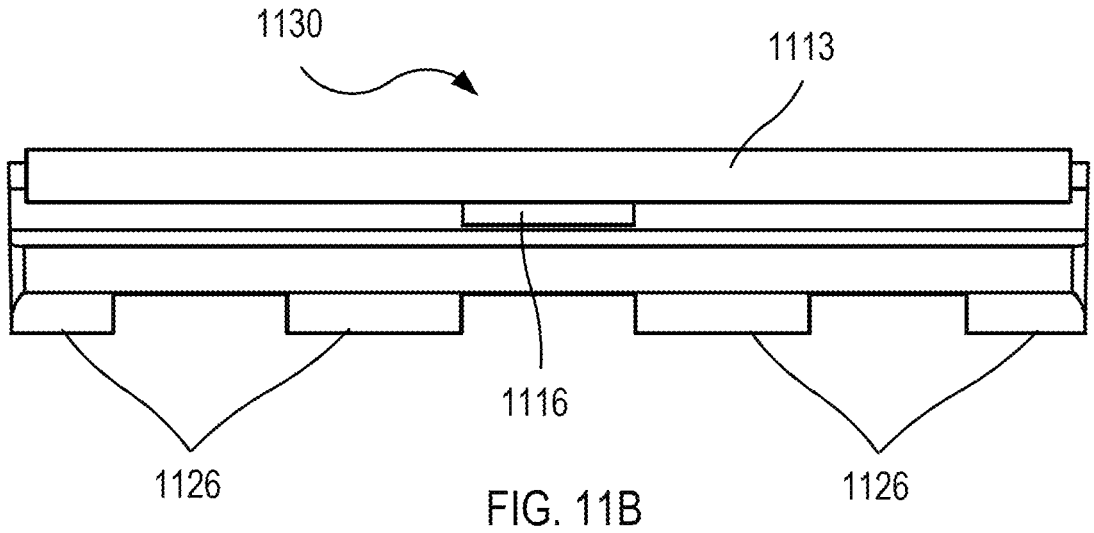
FIG. 11B shows a view of a modular case housing, according to embodiments of the present invention.

FIG. 11A provides a front view of a housing 1130 of a case, according to embodiments of the present invention. As shown here, housing 1130 includes multiple protuberances 1126. FIG. 11B provides a rear view of a housing 1130 of a case, according to embodiments of the present invention. As shown here, housing 1130 includes multiple protuberances 1126, and a protrusion 1113 that is coupled with a longitudinal slot 1112 via one or more posts 1116.

Although the preceding description contains significant detail in relation to certain preferred embodiments, it should not be construed as limiting the scope of the invention but rather as providing illustrations of the preferred embodiments.

Embodiments of the present invention encompass kits having one or more components of a modular cosmetic case as disclosed herein. In some embodiments, the kit includes one or more modular cosmetic case components, along with instructions for using the device(s) for example according to any of the methods disclosed herein.

All features of the described systems and devices are applicable to the described methods mutatis mutandis, and vice versa.

Although the foregoing invention has been described in some detail by way of illustration and example for purposes of clarity of understanding, one of skill in the art will appreciate that certain changes, modifications, alternate constructions, and/or equivalents may be practiced or employed as desired, and within the scope of the appended claims. In addition, each reference provided herein in incorporated by reference in its entirety to the same extent as if each reference were individually incorporated by reference. Relatedly, all publications, patents, patent applications, journal articles, books, technical references, and the like mentioned in this specification are herein incorporated by reference to the same extent as if each individual publication, patent, patent application, journal article, book, technical reference, or the like was specifically and individually indicated to be incorporated by reference.

What is claimed is:

1. A modular cosmetic case, comprising:

a cover having a first lateral side and a second lateral side, the first lateral side of the cover having a plurality of protuberances;

a housing having a first lateral side and a second lateral side, the first lateral side of the housing having a plurality of protuberances and a plurality of slits; and a base having a first lateral side and a second lateral side, the first lateral side of the base having a plurality of slits, wherein the first lateral side of the housing comprises a longitudinal slot and a protrusion on the longitudinal slot, the protrusion defining a central longitudinal axis, wherein the first lateral side of the base comprises a longitudinal slot and a protrusion on the longitudinal slot, the protrusion defining a central longitudinal axis, wherein the plurality of protuberances of the first lateral side of the cover engage the protrusion of the first lateral side of the housing, wherein the plurality of protuberances of the first lateral side of the housing engage the protrusion of the first lateral side of the base, wherein the plurality protuberances of the cover respectively engage the plurality of slits of the housing when the cover and the housing are in an open configuration relative to one another, and wherein the plurality of protuberances of the housing respectively engage the plurality of slits of the base when the housing and the base are in an open configuration relative to one another;

wherein the plurality protuberances of the cover do not respectively engage the plurality of slits of the housing when the cover and the housing are in a closed configuration relative to one another, thereby permitting the plurality of protuberances of the cover to slide along the longitudinal slot of the housing and relative to the central longitudinal axis of the protrusion of the housing, and wherein the plurality protuberances of the housing do not respectively engage the plurality of slits of the base when the housing and the base are in a closed configuration relative to one another, thereby permitting the plurality of protuberances of the housing to slide along the longitudinal slot of the base and relative to the central longitudinal axis of the protrusion of the base.

2. The modular cosmetic case of claim 1, wherein each of the plurality of protuberances of the first lateral side of the cover has a concave surface, wherein the protrusion of the first lateral side of the housing has a convex surface, and wherein the concave surfaces of each of the plurality of protuberances of the first lateral side of the cover engage the convex surface of the protrusion of the first lateral side of the housing.

3. The modular cosmetic case of claim 1, wherein each of the plurality of protuberances of the first lateral side of the housing has a concave surface, wherein the protrusion of the first lateral side of the base has a convex surface, and wherein the concave surfaces of each of the plurality of protuberances of the first lateral side of the housing engage the convex surface of the protrusion of the first lateral side of the base.

4. The modular cosmetic case of claim 1, wherein each of the plurality of protuberances of the first lateral side of the cover has a concave surface, wherein each of the plurality of protuberances of the first lateral side of the housing has a concave surface, wherein the protrusion of the first lateral side of the housing has a convex surface, wherein the protrusion of the first lateral side of the base has a convex surface, wherein the concave surfaces of each of the plurality of protuberances of the first lateral side of the cover engage the convex surface of the protrusion of the first lateral side of the housing, and wherein the concave surfaces of each of the plurality of protuberances of the first lateral side of the housing engage the convex surface of the protrusion of the first lateral side of the base.

5. The modular cosmetic case of claim 1, wherein the housing comprises a plurality of posts, and the plurality of slits of the housing are defined at least in part by the plurality of posts of the housing, and wherein the base comprises a plurality of posts, and the plurality of slits of the base are defined at least in part by the plurality of posts of the base.

6. The modular cosmetic case of claim 1, wherein the central longitudinal axis of the protrusion of the housing and the central longitudinal axis of the base are in vertical alignment when the housing and the base are in a closed configuration, and wherein the central longitudinal axis of the protrusion of the housing and the central longitudinal axis of the base are not in vertical alignment when the housing and the base are in an open configuration.

7. The modular cosmetic case of claim 1, wherein the cover and the housing rotate relative to one another about the central longitudinal axis of the protrusion of the housing, and wherein the housing and the base rotate relative to one another about the central longitudinal axis of the protrusion of the base.

8. The modular cosmetic case of claim 1, wherein each of the plurality of protuberances of the first lateral side of the cover has a convex surface, wherein each of the plurality of protuberances of the first lateral side of the housing has a convex surface, wherein the longitudinal slot of the housing has a concave surface, wherein the longitudinal slot of the base has a concave surface, wherein each of the convex surfaces of the plurality of protuberances of the cover engages the concave surface of the longitudinal slot of the housing, and wherein each of the convex surface of the plurality of protuberances of the housing engages the concave surface of the longitudinal slot of the base.

* * * * *